US005237544A

United States Patent [19]

Sase et al.

[11] Patent Number: 5,237,544

[45] Date of Patent: Aug. 17, 1993

[54] ANALOG WORLD WATCH

[75] Inventors: Masahiro Sase, Fussa; Kiyotaka Igarashi, Tokyo; Takashi Osa, Hachioji; Noritoshi Suzuki, Kawaguchi, all of Japan

[73] Assignee: Citizen Watch Co., Ltd., Tokyo, Japan

[21] Appl. No.: 548,369

[22] Filed: Jul. 5, 1990

[30] Foreign Application Priority Data

| | | | |
|---|---|---|---|
| Jul. 7, 1989 | [JP] | Japan | 1-174081 |
| Jul. 28, 1989 | [JP] | Japan | 1-195567 |
| May 8, 1990 | [JP] | Japan | 2-047392[U] |

[51] Int. Cl.[5] ..... G04B 19/22

[52] U.S. Cl. ..... 368/21; 368/22

[58] Field of Search ..... 368/21, 22, 20, 27

[56] References Cited

U.S. PATENT DOCUMENTS

| | | | |
|---|---|---|---|
| 3,633,354 | 1/1972 | Stemmler | 58/43 |
| 3,653,204 | 4/1972 | Miwa | 368/21 |
| 3,940,920 | 3/1976 | Nakamura et al. | 368/21 |
| 4,133,170 | 1/1979 | Kashio | 368/21 |
| 4,180,969 | 1/1980 | Naito | 368/21 |
| 4,620,797 | 11/1986 | Besson et al. | 368/21 |
| 4,847,819 | 7/1989 | Hong | 368/21 |
| 5,054,008 | 10/1991 | Darling | 368/21 |

FOREIGN PATENT DOCUMENTS

| | | |
|---|---|---|
| 0247520 | 5/1987 | European Pat. Off. . |
| 54-98653 | 8/1979 | Japan . |
| 55-136977 | 10/1980 | Japan . |
| 61-30711 | 7/1986 | Japan . |

OTHER PUBLICATIONS

WO89/09950 Oct. 19, 1989 Published PCT Application Translation.

*Primary Examiner*—Bernard Roskoski

*Attorney, Agent, or Firm*—Finnegan, Henderson, Farabow, Garrett and Dunner

[57] ABSTRACT

A world watch has an hour hand and a minute hand for usual time indication, a plurality of symbols disposed on a dial to represent areas having respective time differences, an area including hand for specifying one of the areas by indicating one of the symbols, a local time indicating hand for indicating the local time of the specified area at least in hours, and a date indicating hand for indicating a date of the specified area. The world watch comprises counters for counting the numbers of driving signals used for driving the area indicating hand and local time indicating hand, respectively; and a drive controlling circuit for generating, when the count of at least one of the counters reaches a predetermined value, a driving signal for driving the date indicating hand in a normal or reverse turning direction based on a judgment whether the predetermined value has been described by an increase in the count or by a decrease in the count. With this arrangement, the standard time and date of an optical area are correctly and easily displayed.

12 Claims, 32 Drawing Sheets

65 TIME DISPLAY MEANS
66
TIME SIGNAL GENERATING CIRCUIT
69 P69
60 BASE COUNTER
Q
R
I
67
68
71 DRIVE CONTROLLING CIRCUIT
72 AREA SELECTION CIRCUIT
AREA CHANGE SIGNAL GENERATING CIRCUIT
76
75
DUAL TIME RETURN SIGNAL GENERATING CIRCUIT
77
TIME FREQUENCY DIVIDING CIRCUIT
51
TIME REFERENCE SOURCE
50
52 SWITCHING CIRCUIT
P58
P63
63
58
Vss
53

| | | |
|---|---|---|
| Fig.5A | Fig.5B | Fig.5C |
| Fig.5D | Fig.5E | Fig.5F |

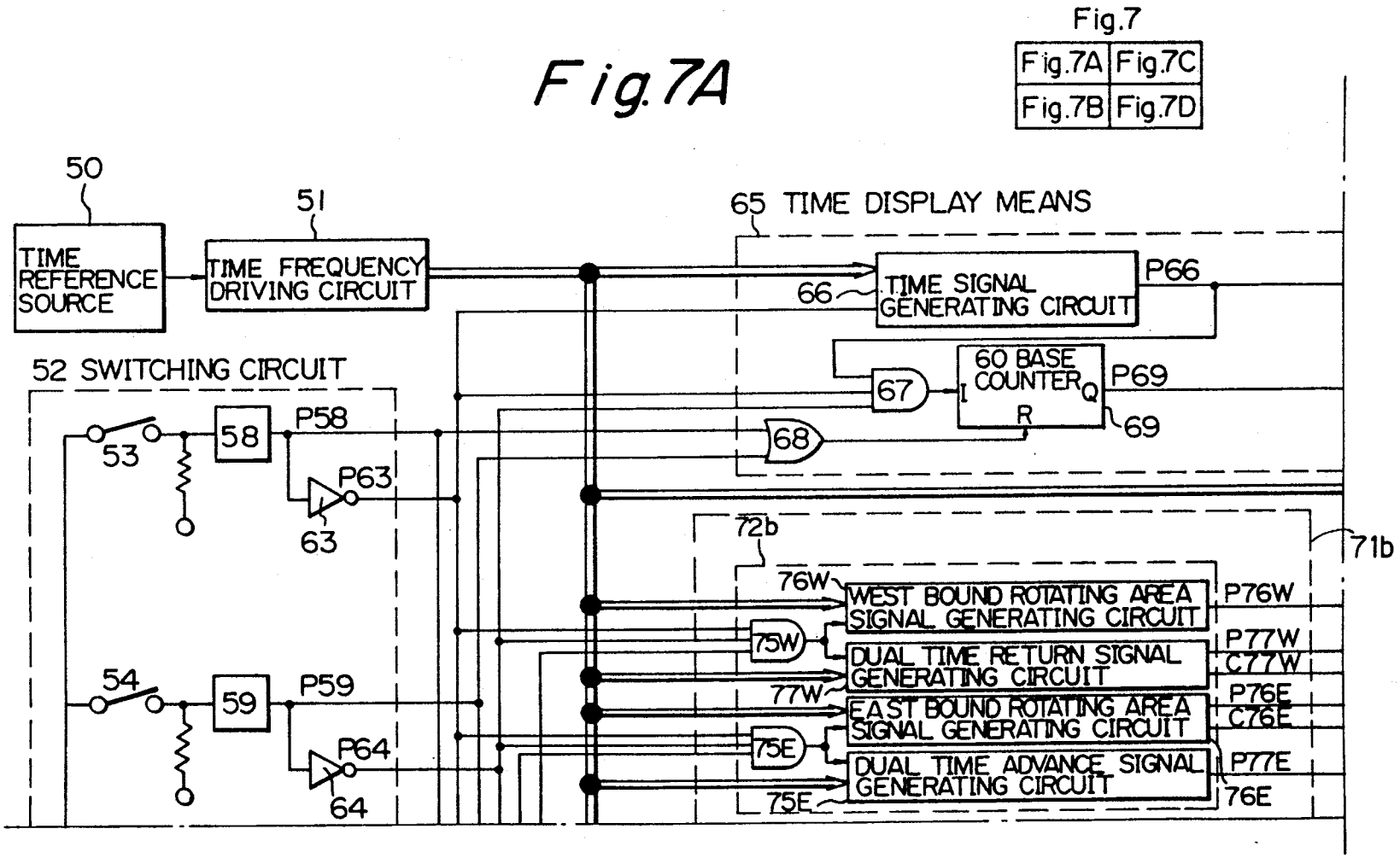
Fig.7
Fig.7A
Fig.7B
Fig.7C
Fig.7D
Fig.7A
65 TIME DISPLAY MEANS
TIME SIGNAL GENERATING CIRCUIT
66
P66
60 BASE COUNTER
Q
R
P69
69
67
68
71b
72b
WEST BOUND ROTATING AREA SIGNAL GENERATING CIRCUIT
76W
P76W
DUAL TIME RETURN SIGNAL GENERATING CIRCUIT
77W
P77W
C77W
EAST BOUND ROTATING AREA SIGNAL GENERATING CIRCUIT
P76E
C76E
DUAL TIME ADVANCE SIGNAL GENERATING CIRCUIT
76E
P77E
75W
75E
TIME FREQUENCY DRIVING CIRCUIT
51
TIME REFERENCE SOURCE
50
52 SWITCHING CIRCUIT
P58
P63
63
58
53
P59
P64
64
59
54

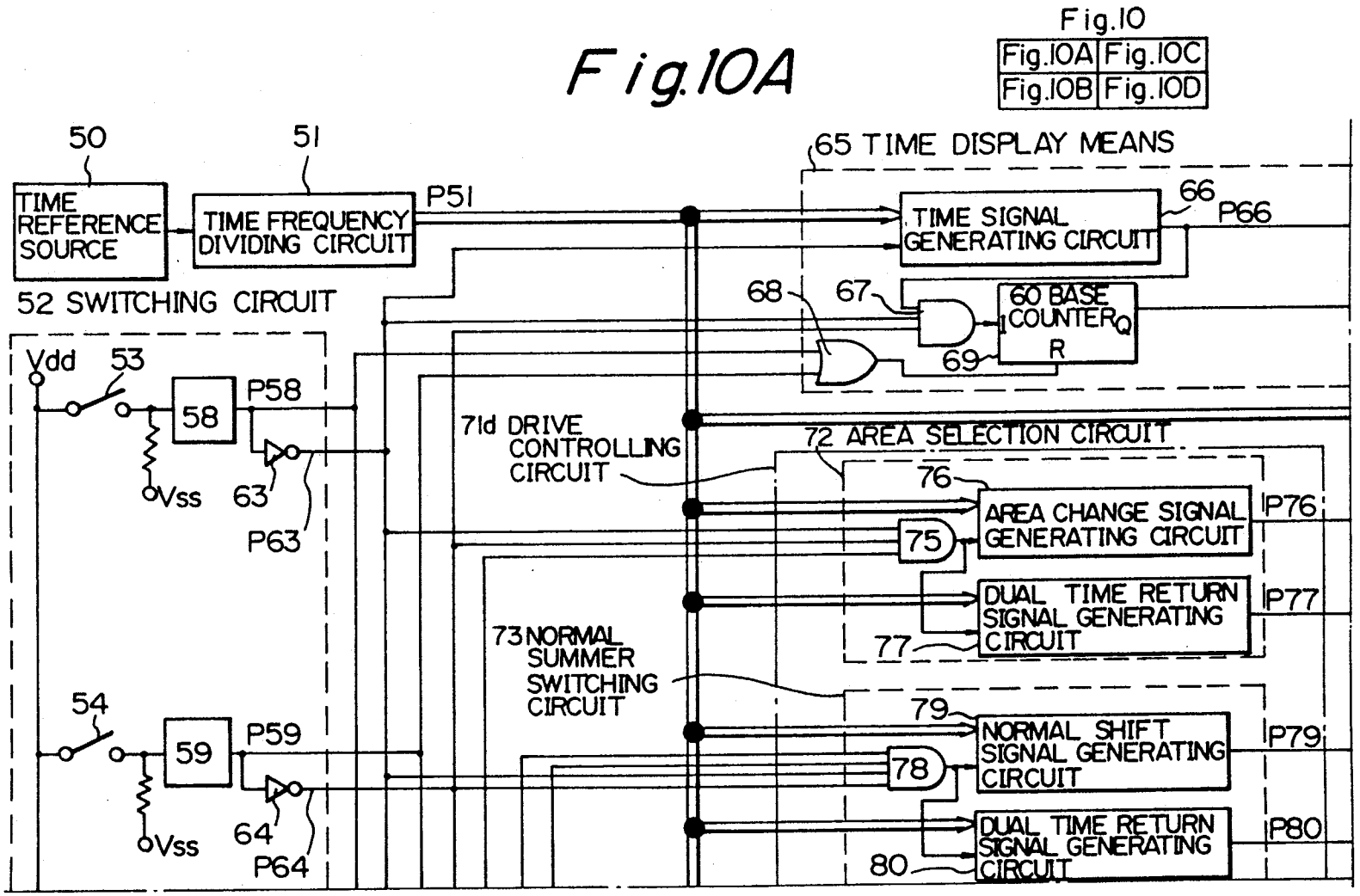
Fig.10
Fig.10A
Fig.10B
Fig.10C
Fig.10D
65 TIME DISPLAY MEANS
66
P66
TIME SIGNAL GENERATING CIRCUIT
60 BASE COUNTER
Q
R
67
68
69
72 AREA SELECTION CIRCUIT
P76
AREA CHANGE SIGNAL GENERATING CIRCUIT
76
75
P77
DUAL TIME RETURN SIGNAL GENERATING CIRCUIT
77
P79
NORMAL SHIFT SIGNAL GENERATING CIRCUIT
79
78
P80
DUAL TIME RETURN SIGNAL GENERATING CIRCUIT
80
71d DRIVE CONTROLLING CIRCUIT
73 NORMAL SUMMER SWITCHING CIRCUIT
P51
TIME FREQUENCY DIVIDING CIRCUIT
51
50
TIME REFERENCE SOURCE
52 SWITCHING CIRCUIT
P58
58
63
P63
Vss
53
Vdd
P59
59
64
P64
Vss
54

ANALOG WORLD WATCH

BACKGROUND OF THE INVENTION

1. Field of the Invention

The present invention relates to an analog world watch having a world time function for indicating the local time of a present place as well as the standard time of an optionally selected area, or in addition, a date of the selected area.

2. Description of the Prior Art

Presently, most of watches manufactured and sold are analog watches and their demand is gradually increasing. In addition to essential hour, minute and second hands, recent watches have hands serving for stopwatch and timer functions and hands for indicating a date. These multiple hands, multiple functions and multiple information are being demanded also for world watches. For example, one world watch has a hand or a disk that rotates once per 24 hours, thereby indicating multiple hours. These multifunction watches are widely marketed.

Conventional analog world watches, however, do not usually have a function of indicating a date and, even when they have the function, involve a very difficult mechanism of returning the date. Namely, their mechanisms advance a date for every 24 hours, so that, for a plurality of areas, they may indicate the local time of selected one of the areas but, due to mechanical difficulties not a date of the selected area.

In addition, the conventional watches do not have a mechanism to changing a date on the International Date Line in selecting one of a plurality of areas according to elapsed time.

The conventional analog world watches never consider daylight saving time (summer time), so that, if an area indicating hand is adjusted to an area where the summer time is effective, one must calculate the actual time of the area by reading one hour ahead the indication of a dual time hand (a local time indicating hand) of the watch, or must adjust the area indicating hand to another area on the east side of the target area in reading the actual time of the target area. Namely, a user of the conventional watch must adjust the area or the time by itself for the summer time.

SUMMARY OF THE INVENTION

An object of the present invention is to provide an analog world watch that can solve the above problems. The watch according to the present invention has a simple structure and logic circuits that can correctly indicate the time and date of a selected area, taking the summer time and standard time of the area into account.

To achieve the object, a world watch according to a basic aspect of the present invention has an hour hand and a minute hand for usual time indication, a plurality of symbols disposed on a dial to represent areas having respective time differences, an area indicating hand for specifying one of the areas by indicating one of the symbols, a local time indicating hand for indicating the local time of the specified area at least in hours, and a date indicating hand for indicating a date of the specified area. The hands are driven by respective step motors each having a driving circuit. This world watch comprises counters for counting the number of driving signals used for driving the area indicating hand and local time indicating hand, respectively; and a drive controlling circuit for generating, when the count of at least one of the counters reaches a predetermined value, a driving signal for driving the date indicating hand in a normal or reverse turning direction based on a judgment whether the predetermined value has been attained by an increase in the count or by a decrease in the count.

According to another aspect of the present invention, an analog world watch has a world time function for indicating, in addition to the time of a present place, the standard time of another place. This watch comprises a first dial having a plurality of zones each having a reference mark such as a city name, the zones being defined by angles corresponding to time differences relative to the Greenwich Mean Time (GMT) or the World Time defined by Universal Time Coordinated (UTC); a first hand for indicating one of the marks of the zones on the first dial; a second dial having normal time and summer time symbols for identifying that presently displayed world time is normal time or summer time; a second hand for indicting one of the symbols on the second dial; a drive controlling circuit for calculating a specific time difference, relative to the GMT, of one of the zones when the second hand is indicating the normal time symbol of the one zone, and calculating the summer time for the one zone by adding one hour to the calculates specific time difference when the second hand is indicating the summer time symbol of the one zone; and a displaying device for switching and displaying the local time of the one zone with hands, based on a result of the calculation of the drive controlling circuit.

According to the present invention, areas on the earth have respective local standard hours. The areas are classified into a group having a today's date and a group having a yesterday's date. Ratios of the groups change according to elapsing time. The groups may be expressed as today's group and tomorrow's group, if a reference is changed and the areas are rearranged. Based on these facts, the present invention employs control circuits and discrimination circuits, thus realizing the world watch mentioned above. The present invention judges an increase or a decrease in the count of the counter, and drives a date controlling circuit in a normal or reverse turning direction, thereby correctly displaying the time and date of an optional area.

A user of the watch may select an optional area (city) with the area indicating hand and, in the area, normal time or summer time with a mode hand. According to these selections, the watch automatically corrects and indicates the normal or summer time and date of the selected area.

BRIEF DESCRIPTION OF THE DRAWINGS

FIGS. 7A, 7B, 7C, and 7D when arranged as in FIG. 7 is a circuit block diagram showing a third embodiment of the present invention;

FIGS. 10A, 10B, 10C, and 10D when arranged as in FIG. 10 is a circuit block diagram showing the fifth embodiment of the present invention.

DESCRIPTION OF THE PREFERRED EMBODIMENT

Preferred embodiments of the present invention will be explained with reference to the drawings.

EXAMPLE 1

Figure 1:
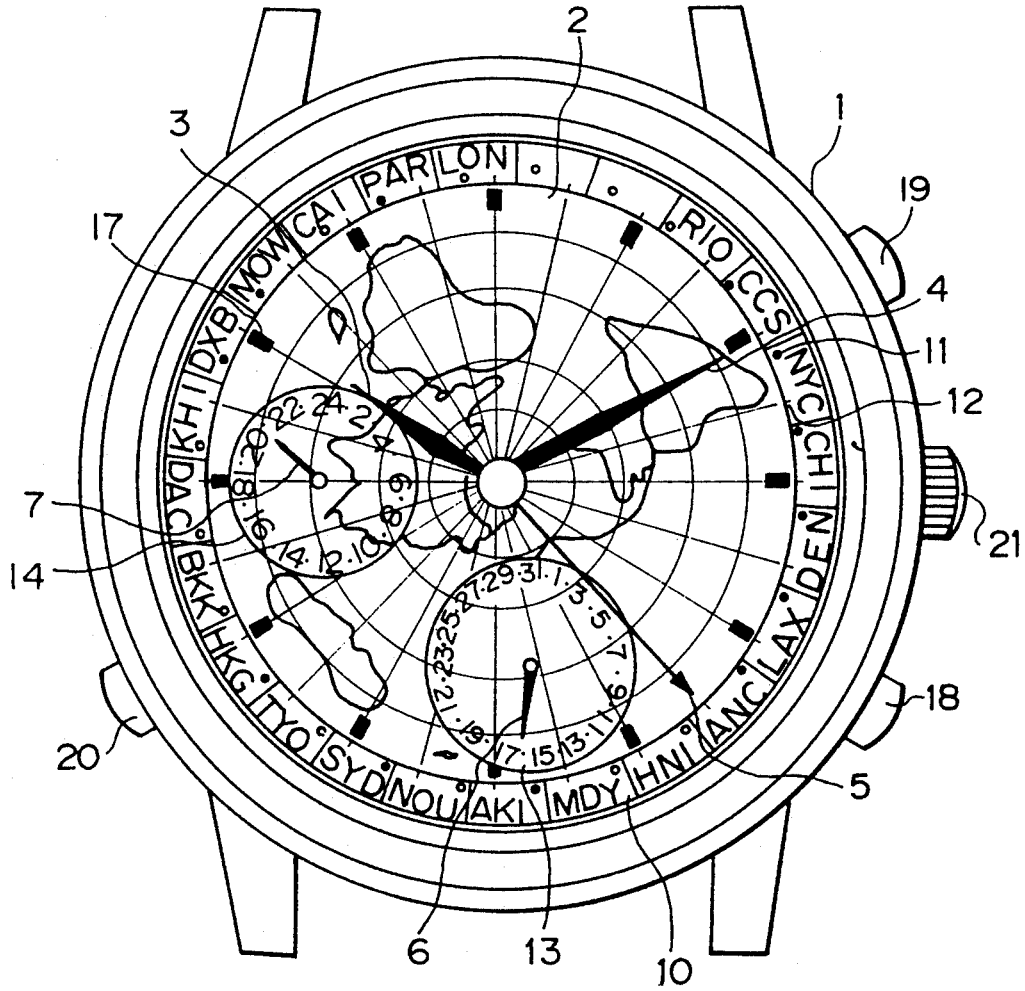
FIG. 1 is a front view showing the exterior of a world watch according to the present invention.

FIG. 1 is an external plan view showing an analog electronic watch according to the present invention. The watch has a function of synchronizing the date and time of a selected area of the world.

In the figure, numeral 1 denotes the electronic watch, and numeral 2 is a dial. A world map is printed on the dial 2 with the North Pole at the center.

On the side face of the electronic watch 1, there are arranged a crown 21, an area selecting button 18, a normal/summer switching button 19, and a button 20. When the crown 21 is pulled to a second pulled position, a switch 53 is activated. When the crown 21 is set to a first pulled position, a switch 54 is activated. When the area selecting button 18 is pushed, a switch 55 is activated. When the normal/summer switching button 19 is pushed, a switch 56 is activated. When the button 20 is pushed, a switch 57 is activated.

An hour hand 3 and a minute hand 4 are fitted to the center of the dial 2. In combination with an hour/minute scale 17 printed on the dial 2, the hands 3 and 4 indicate time.

An area indicating hand 5 is fitted to the center of the dial 2. In combination with regional name symbols (city name symbols) 10, the hand 5 selects an area. The area indicating hand 5 may indicate a dot-like summer time scale 11 or a bar-like normal time scale 12. The summer time scale 11 involves black dots and white dots. The black dots represent areas that put summer time into effect, while the white dots represent areas that do not put the summer time into effect. When the hand 5 is set to the summer time scale 11, a summer time function for a summer time period is selected, and when the hand is set to the normal time scale 12, a normal time function for a normal time period excluding the summer time period is selected.

A dual time hand 7 is fitted to the dial 2 at a nine o'clock position. Numerals 14 for dual time are printed on the dial 2 around the dial time hand 7. A date hand 6 is fitted to the dial 2 at a six o'clock position. Numerals 13 for dates are printed on the dial 2 around the date hand 6. The dual time hand 7 and date hand 6 can ell the date and hours in summer time or in normal time of an area, i.e., a city indicated by the area indicating hand 5. The International Date Line is supposed to run between AKL (Auckland) and MDY (Midway).

Figures 2, 2A, 2B, 2C, 2D, 2E, 2F:
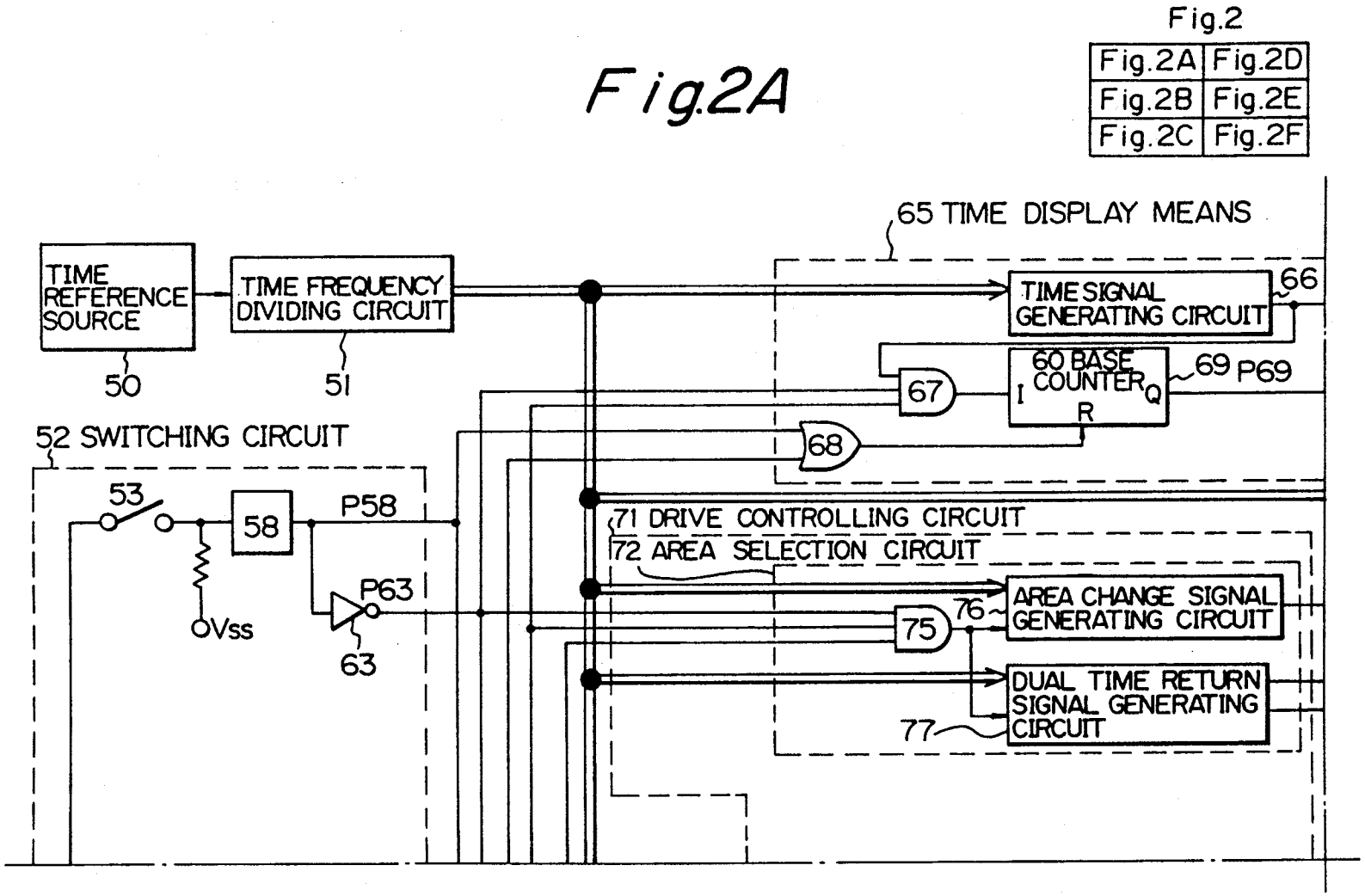
FIGS. 2A, 2B, 2C, 2D, 2E, and 2F when arranged as in FIG. 2 is a circuit block diagram showing a world watch according to a first embodiment of the present invention.
Figure 2B:
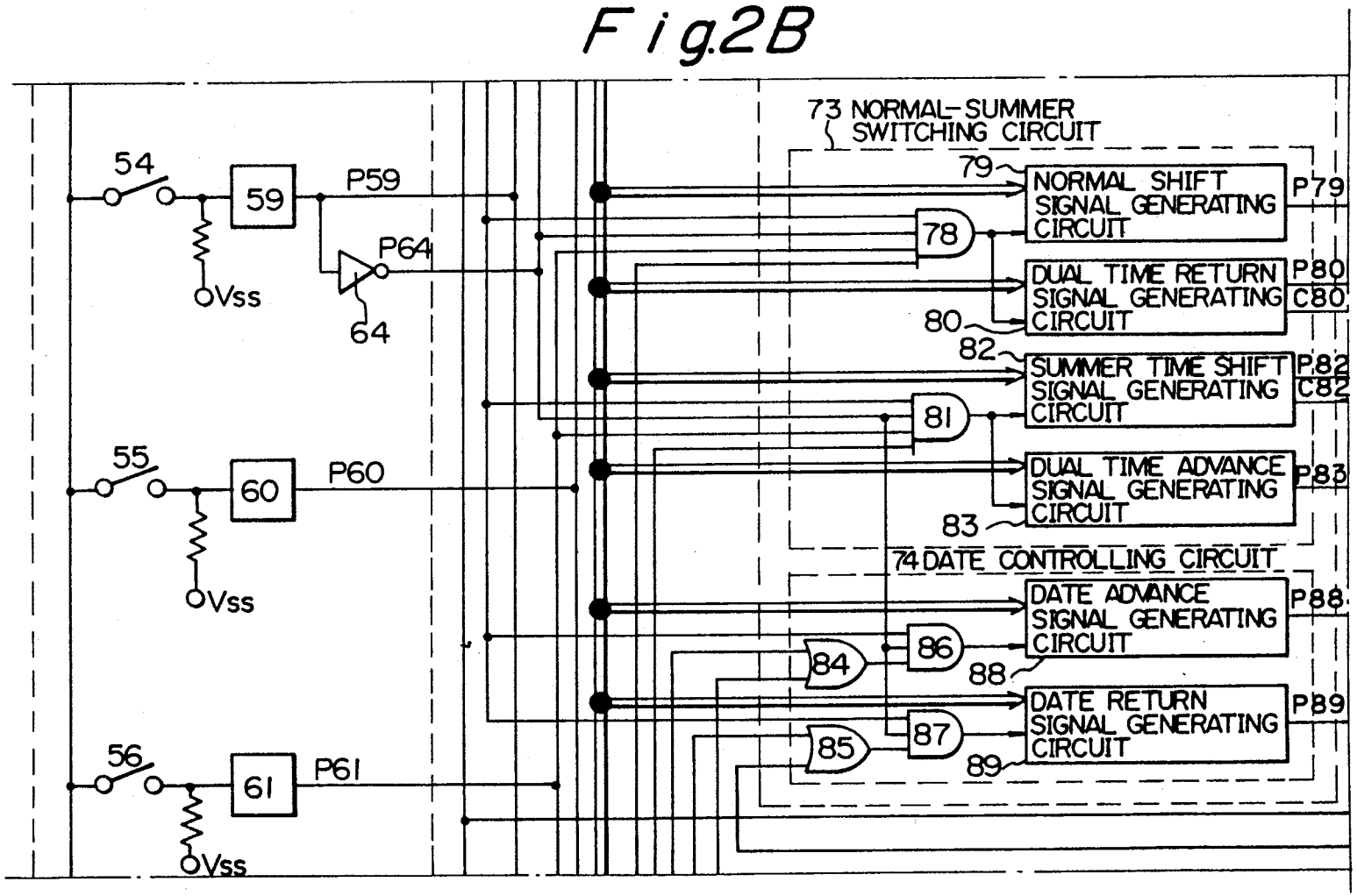
Figure 2C:
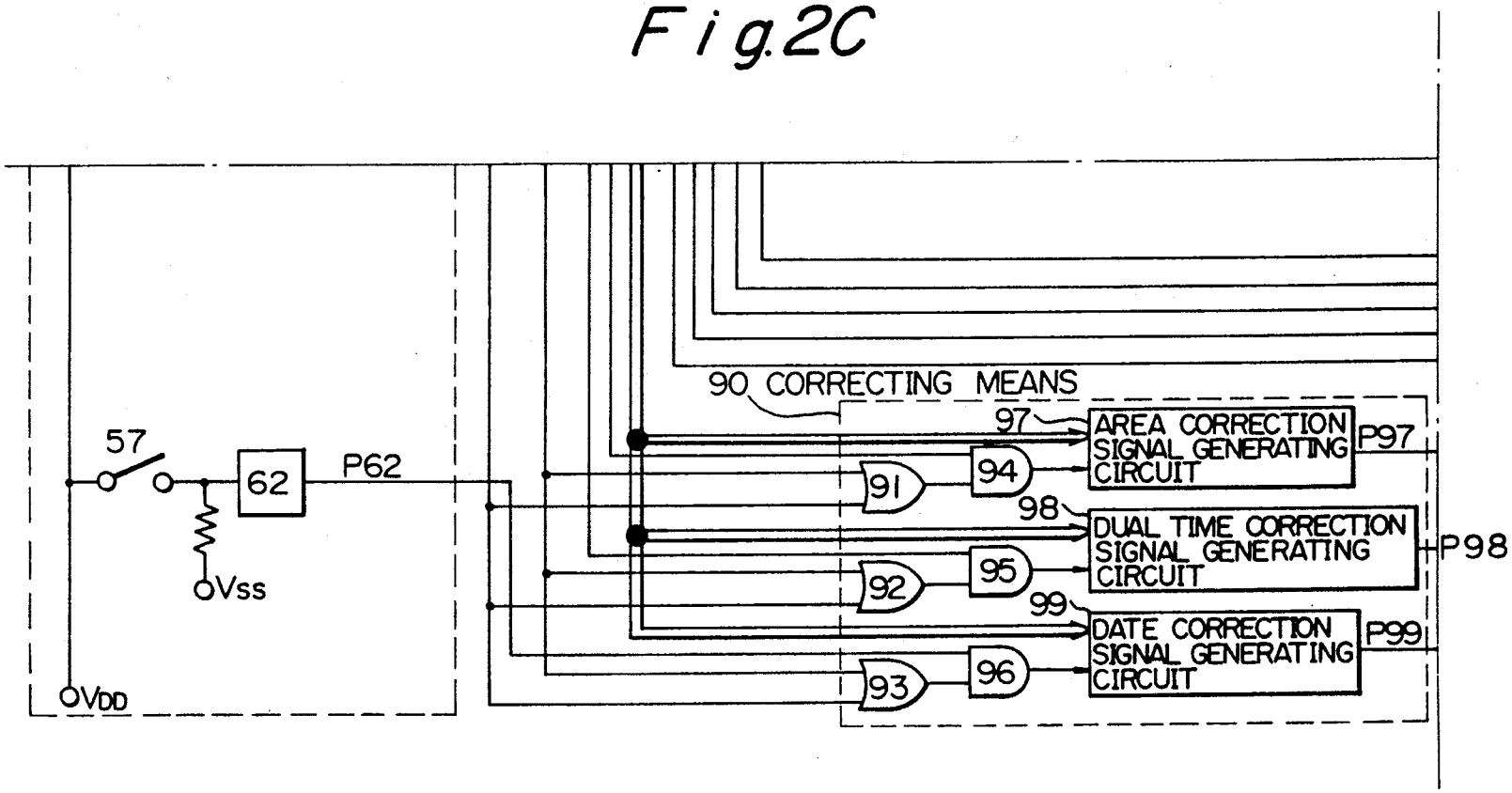
Figure 2D:
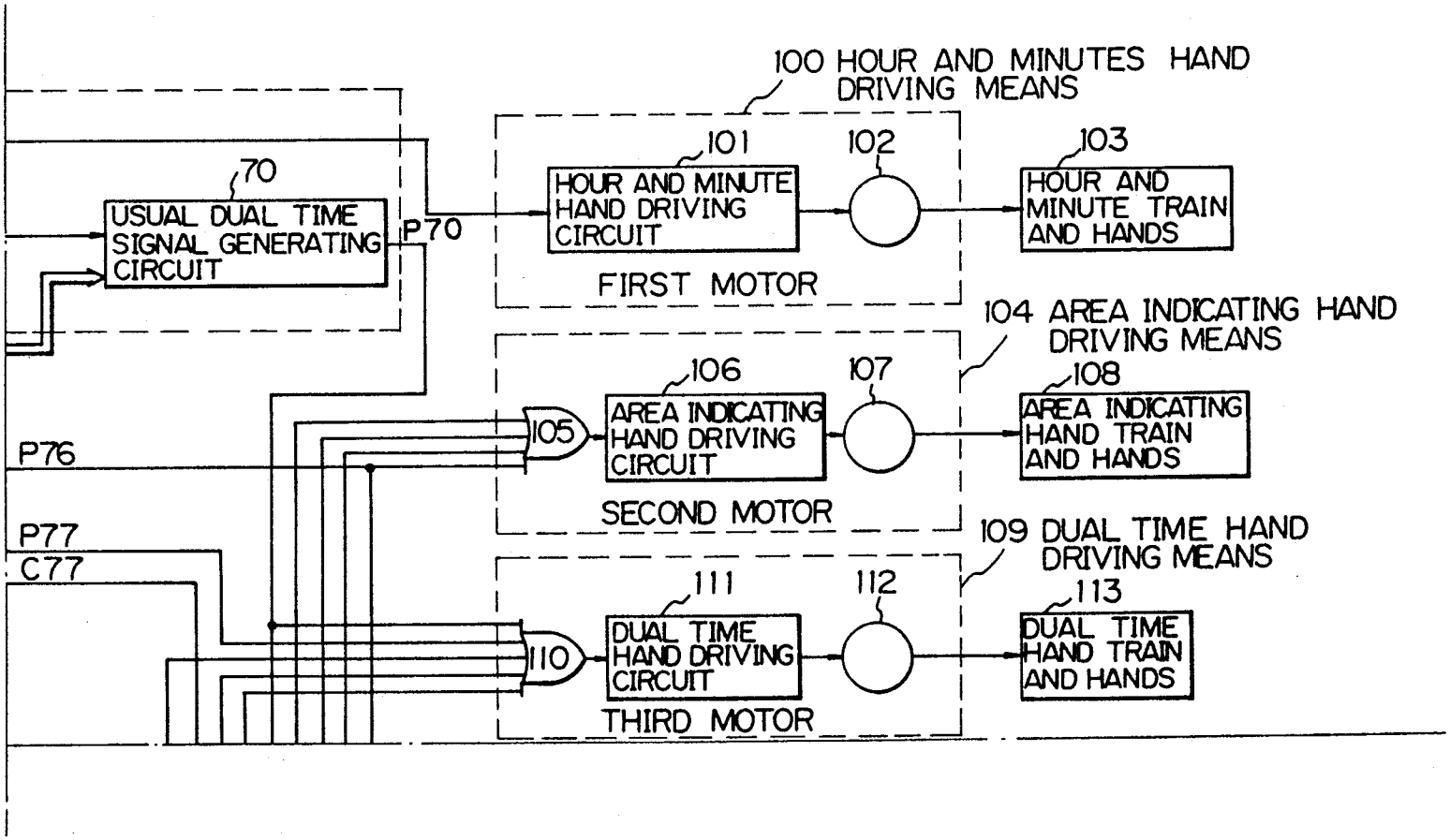
Figure 2E:
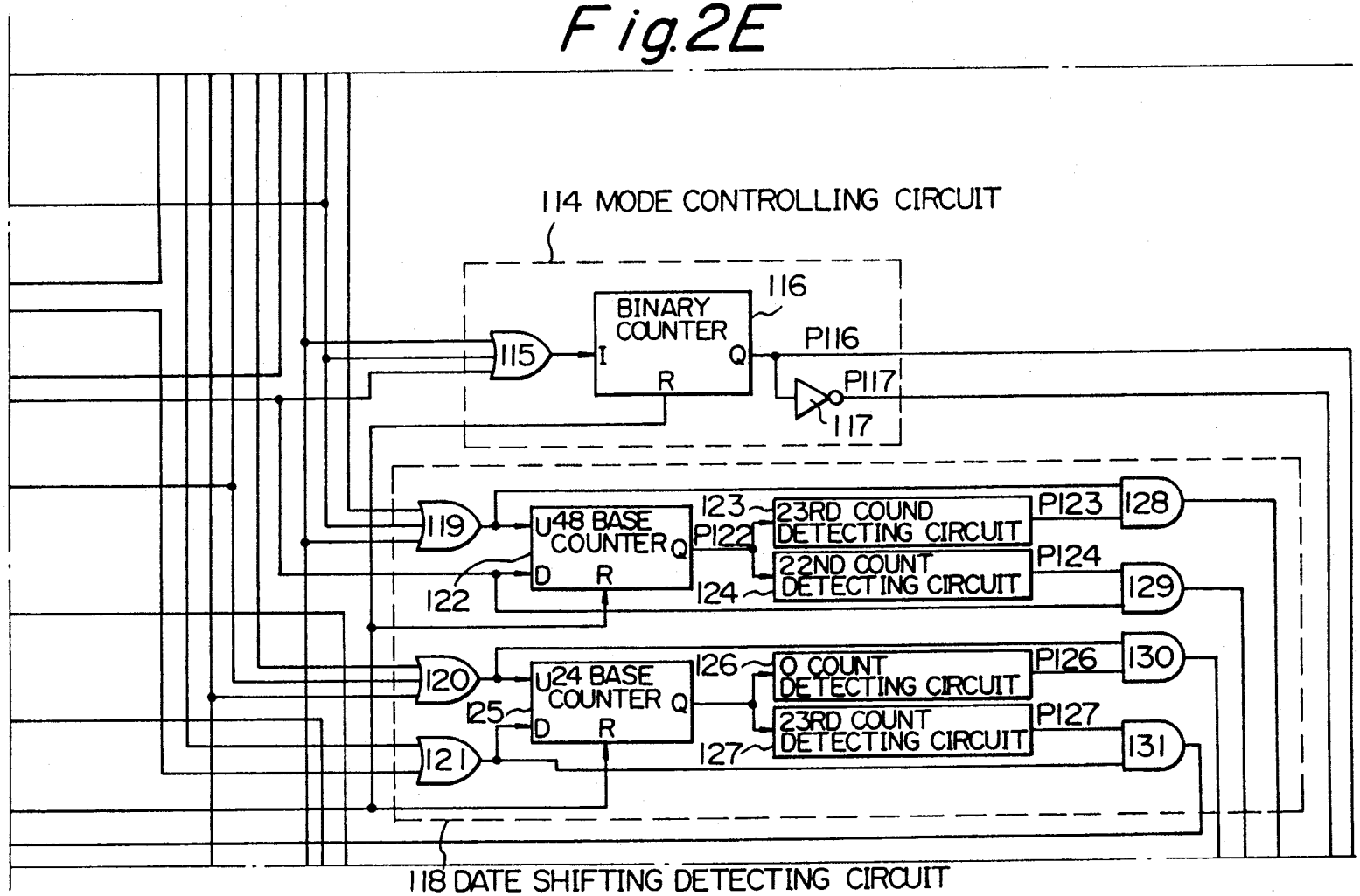
Figure 2F:
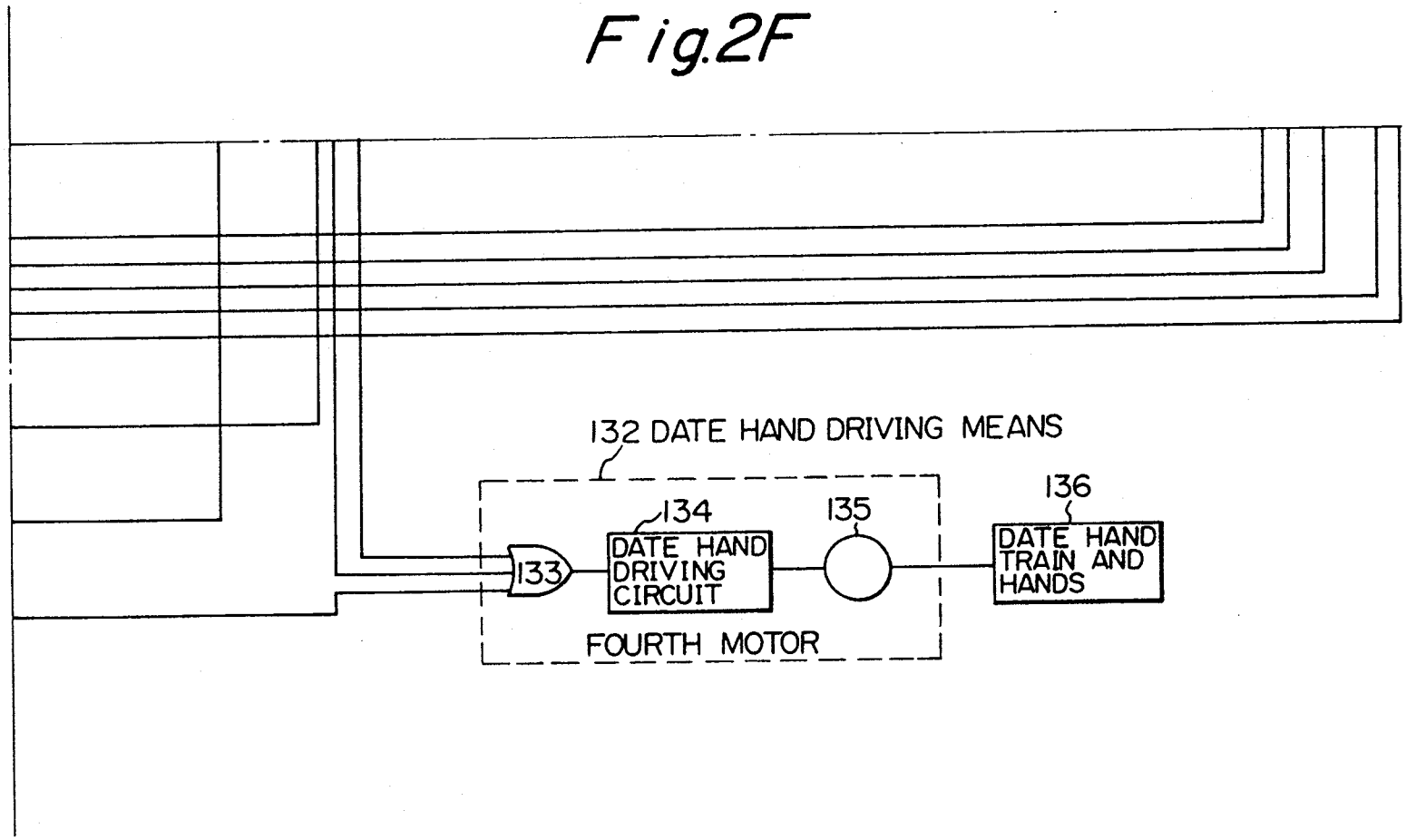

FIG. 2 is a circuit block diagram showing the embodiment of FIG. 1.

The arrangement of FIG. 2 comprises a time reference source 50; a time frequency dividing circuit 51 for providing, according to output signals from the time reference source 50, frequency-divided signals P51 of various frequencies for producing driving pulses of different frequencies and widths; a switching circuit 52; a time display means 65; a drive controlling circuit 71 including a area selecting circuit 72, a normal/summer switching circuit 73 and a date controlling circuit 74; a correcting means 90; an hour and minute hands driving means 100; an hour and minute hands train and hands 103 interlocking with the hour and minute hands driving means 100; an area indicating hand driving means 104; an area indicating hand train and hand 108 interlocking with the area indicating hand driving means 104; a dual time hand driving means 109; a dual time hand train and hand 113 interlocking with the dual time hand driving means 109; a mode controlling circuit 114; a date shifting detecting circuit 118; a date hand driving means 132; and a date hand train and hand 136 interlocking with the date hand driving means 132.

The switching circuit 52 comprises switches 53 to 57, chattering preventive circuits 58 to 62 and inverters (hereinafter referred to as INVs) 63 and 64. When the crown 21 is set to the second pulled position, the chattering preventive circuit 58 provides a crown-second-pulled-position signal P58. When the crown 21 is not in the second pulled position, the INV 63 provides an inverted crown-second-pulled-position signal P63. Similarly, depending on whether the crown 21 is in the first pulled position or not, the chattering preventive circuit 59 or the INV 64 provides a crown-first-pulled-position signal P59 or an inverted crown-first-pulled-position signal 64.

When the area selecting button 18, normal/summer switching button 19 and button 20 are pushed, the chattering preventive circuits 60 to 62 provide a one-shot first push signal P60, second push signal P61 and third push signal P62, respectively.

The time display means 65 comprises a time signal generating circuit 66, an AND gate (hereinafter referred to as AND) 67, an OR gate (hereinafter referred to as OR), 68, a 60-base counter 69 and a usual dual time signal generating circuit 70.

The area selecting circuit 72 comprises an AND 75, an area change signal generating circuit 76 and a dual time return signal generating circuit 77.

The normal/summer switching circuit 73 comprises ANDs 78 and 81, a normal shift signal generating circuit 79, a dual time return signal generating circuit 80, a summer time shaft signal generating circuit 82 and a dual time advance signal generating circuit 83.

The date controlling circuit 74 comprises ORs 84 and 85, ANDs 86 and 87, a date advance signal generating circuit 88 and a date return signal generating circuit 89. The correcting means 90 comprises ORs 91 to 93, ANDs 94 to 96, an area correction signal generating circuit 97, a dual time correction signal generating circuit 98 and a date correction signal generating circuit 99.

The hour and minute hands driving means 100 comprises an hour and minute hands driving circuit 101 and a first motor 102 driven by output signals of the circuit 101. In this embodiment, all motors are step motors.

The area indicating hand driving means 104 comprises an OR 105, an area indicating hand driving circuit 106 and a second motor 107 driven by output signals of the circuit 106.

The dual time hand driving means 109 comprises an OR 110, a dual time hand driving circuit 111 and a third motor 112 driven by output signals of the circuit 111.

The mode controlling circuit 114 comprises an OR 115, a binary counter 116 and an INV 117. The binary counter 116 receives an output signal of the OR 115 through its input terminal I and the crown-second-pulled-position signal P58 through its reset input terminal R, and provides, under a summer time function selected state, a summer mode signal P116 through its output terminal Q and, under a normal time function selected state, a normal mode signal P117 through the INV 117.

The date shifting detecting circuit 118 comprises ORs 119 to 121; a 48-base counter 122; 23rd count and 22nd count detecting circuits 123 and 124 for detecting counts 23 and 22, respectively, on an output terminal Q of the counter 122; a 24-base counter 125; zero count and 23rd count detecting circuits 126 and 127 for detecting counts zero and 23, respectively, on an output terminal Q of the counter 125; and ANDs 128 to 131. An input terminal U of the 48-base counter 122 receives an output signal P119 from the OR 119. The signal P119 is a count-up signal for the counter 122. An input terminal D of the 48-base counter 122 receives a count signal C82 from the summer time shift signal generating circuit 82. The signal C82 is a count-down signal for the counter 122. Similarly, input terminals U and D of the 24-base counter 125 receive signals P70, P83, P98, C77, C80, etc., that serve for counting up or down in the counter 125. Terminals R of both the counters 122 and 125 receive the crown-second-pulled-position signal P58 with which both the counters are reset.

The date hand driving means 132 comprises an OR 133, a date hand driving circuit 134 and a fourth motor 135 driven by the circuit 134.

Next, an operation of FIG. 2 will be explained.

When the crown 21 is set to the second pulled position and turned, the hour hand 3 and minute hand 4 can mechanically be adjusted for normal time, and the area indicating hand 5 and dual time hand 7 can be initialized. When the crown 21 is set to the first pulled position, the area indicating hand 5, date hand 6 and dual time hand 7 can be adjusted for correcting the date and dual time of a selected area. When the crown 21 is at a normal non-pulled position, it is possible to select an area and know the dual time and date of the area and, if required, to switch the normal time function and summer time function from one to the other.

An operation of the embodiment with the crown 21 being at the second pulled position will be explained.

Under this state, it is supposed that the switching circuit 52 provides the first push signal P60. In the correcting means 90, the OR 91 receives the crown-second-pulled-position signal P58, and the OR 91 provides an output signal of "H" level to the AND 94. The AND 94 outputs the first push signal P60 provided to another input of the AND 94. According to the timing of the first push signal P60 from the AND 94 and predetermined one of the frequency-divided signals P51, the area correction signal generating circuit 97 provides an area correcting signal P97 which is a one-shot signal for driving the area indicating hand 5 once in a normal turning direction. When the signal P97 is supplied to the area indicating hand driving means 104, the area indicating hand 5 is driven once in the normal turning direction.

The area correcting signal P97 is also supplied to the date shifting detecting circuit 118. The 48-base counter 122 of the date shifting detecting circuit 118 is, however, reset by the crown-second-pulled-position signal P58. A user may carry out initialization by adjusting the area indicating hand 5 to a normal time position of LON on the regional name symbols 10, thereby correctly phasing the area indicating hand 5 with the 48-base counter 122 of the date shifting detecting circuit 118. Thereafter, it is possible to detect when the area indicating hand 5 crosses the Date Line that exists between a normal time position of MDY and a summer time position of AKL. The mode controlling circuit 114 also receives the area correcting signal P97. The binary counter 116 is, however, reset by the crown-second-pulled-position signal P58.

Similarly, when the switching circuit 52 provides the second push signal P61, the dual time correction signal generating circuit 98 of the correcting means 90 provides a dual time correction signal P98 for driving the dual time hand 7 once in a normal turning direction. When the signal P98 is supplied to the dual time hand driving means 109, the dual time hand 7 is driven once in the normal turning direction. At the same time, the 24-base counter 125 of the date shifting detecting circuit 118 is reset by the crown-second-pulled-position signal P58. Similar to the case of the area indicating hand 5, the user may carry out initialization by adjusting the dual time hand 7 to "24" on the dual time numerals 14. Thereafter, it is possible to detect when the dual time hand 7 moves from "23" to "24" or from "24" to "23" on the dual time numerals 14.

When the crown 21 is at the second pulled position, the other circuits such as the time display means 65 and drive controlling circuit 71 are not activated at all. The area correction signal P97 is provided to the 48-base counter to indicate one of, for example, 24 cities with the area indicating hand 5 as well as indicating the normal or the summer time of the one selected city. In addition, the signal P97 is needed by the 48-base counter 122 to know under which state the area indicating hand 5 has crossed the Date Line.

Next, an operation of FIG. 2 with the crown 21 being at the first pulled position will be explained.

Under this state, it is supposed that the switching circuit 52 provides the first push signal P60. One input of the OR 91 of the correcting means 90 receives the crown-first-pulled-position signal P59, and the OR provides the signal P59. Similar to the case of the second pulled position, the area indicating hand 5 is once driven in the normal turning direction according to the area correction signal P97.

The mode controlling circuit 114 is not reset when the crown is at the first pulled position, so that an output level of the binary counter 116 is inverted in response to the area correction signal P97. Namely, if a normal mode signal P117 is being provided, a summer mode signal P116 starts to be provided. If, on the other hand, the summer mode signal P116 is being provided, the normal mode signal P117 starts to be provided. In this way, the area indicating hand 5 is alternately corrected to the normal time scale 12 and summer time scale 11 in response to the first push signal P60, and the mode controlling circuit 114 follows this operation.

With the crown 21 at the first pulled position, it is supposed that the switching circuit 52 outputs the second push signal P61. In the correcting means 90, the AND 95 receives the crown-first-pulled-position signal P59 of "H" level as well as the second push signal P61 and outputs the second push signal P61. According to the timing of the second push signal P61 from the AND 95 and predetermined one of the frequency-divided signals P51, and dual time correction signal generating circuit 98 provides a dual time correction signal P98 which is a one-shot signal for driving the dual time hand 7 once in the normal turning direction. When the signal P98 is supplied to the dual time hand driving means 109, the dual time hand 7 is driven once in the normal turning direction. With the crown 21 being at the first pulled position, it is supposed that the switching circuit 52 outputs the third push signal P62. In the correcting means 90, the AND 96 receives the crown-first-pulled-position signal P59 of the "H" level as well as the third push signal P62 and outputs the third push signal P62. According to the timing of the third push signal P62 from the AND 96 and predetermined one of the frequency-divided signals P51, the date correction signal generating circuit 99 provides a date correction signal P99 which is a one-shot signal for driving the date hand 6 once in the normal turning direction. When the signal P99 is supplied to the date hand driving means 132, the date hand 6 is driven once in the normal turning direction.

With the crown 21 being at the first pulled position, the 48-base counter 122 and 24-base counter 125 of the date shifting detecting circuit 118 are not reset, so that the area correction signal P97 from the area correction signal generating circuit 97 is transferred to the terminal U of the 48-base counter 122 via the OR 119, and the dual time correction signal P98 from the dual time correction signal generating circuit 98 is supplied to the terminal U of the 24-base counter 125 via the OR 120. Based on the inputs to the terminals U, both the counters 122 and 125 increase their counts.

When the 22nd count detecting circuit 124 detects from information from the terminal Q of the 48-base counter 122 that the counter 122 has counted 22, the 22nd count detecting circuit 124 provides a detected signal P124 to one input of the AND 129. The other input of the AND 129 receives a count signal C82 from the summer time shaft signal generating circuit 82 of the normal/summer switching circuit 73. When the crown 21 is at the first pulled position, however, the summer time shift signal generating circuit 82 does not provide the signal C82, so that the AND 129 provides no output.

When the 48-base counter 122 counts 23, the 23rd count detecting circuit 123 provides a detected signal P123 to the AND 128. The other input of the AND 128 receives the area correction signal P97, so that the AND 128 provides a signal of "H" level to the AND 86 of the date controlling circuit 74. When the crown 21 is at the first pulled position, however, the inverted crown-first-pulled-position signal P64 provided to the AND 86 is not active, so that the AND 86 provides no output. Similarly, when the 24-base counter 125 counts 23 or 0, the 23rd count detecting circuit 127 or the zero count detecting circuit 126 provides a detected signal. A detected signal P127 from the 23rd count detecting circuit 127 is provided to the AND 131, which provides no output. A detected signal P126 from the zero count detecting circuit 126 is provided to the AND 86, which provides no output.

Namely, with the crown 21 being at the first pulled position, the three buttons 18, 19 and 20 can be pushed to adjust the normal time, summer time and dual time of a selected area. Even if the area indicating hand 5 moves from MDY to AKL and the dual time hand 7 from "23" to "24" on the dual time numerals 14, a set date will have no influence. A position of the area indicating hand 5 is stored in the 48-base counter 122, and a position of the dual time hand 7 is stored in the 24-base counter 125 of the date shifting detecting circuit 118.

With the crown 21 being at the first pulled position, the time signal generating circuit 66 of the time display means 65 is enabled because the switching circuit 52 provides the inverted crown-second-pulled-position signal P63 of "H" level. Accordingly, the time signal generating circuit 66 provides a time signal P66 of one minute interval according to predetermined one of the frequency-divided signals P51. The time signal P66 is supplied to the hour and minute hands driving means 100 to drive the minute hand 4 for every minute, with the hour hand 3 interlocking with the minute hand 4.

When the crown 21 is at the first pulled position, the drive controlling circuit 71 is not operated.

An operation of FIG. 2 with the crown 21 being at a non-pulled position, i.e., a pushed position will be explained.

Firstly, an operation of the time display means 65 with the crown 21 being at the non-pulled position will be explained.

The time signal generating circuit 66 operates in a manner similar to that when the crown 21 is at the first pulled position and drives and minute hand 4 for every minute, with the hour hand 3 interlocking with the minute hand 4. The inverted crown-first-pulled-position and inverted crown-second-pulled-position signals P64 and P63 from the switching circuit 52 are each "H" level and supplied to the AND 67 as its first and second input signals. The AND 67 receives, as its third input signal, the time signal P66 of one minute interval from the time signal generating circuit 66. Since the first and second input signals are each "H" level, the AND 67 outputs the third input signal P66. The OR 68 receives, as its first and second input signals, the crown-second-pulled-position signal P58 and crown-first-pulled-position signal P59 from the switching circuit 52. Since the first and second input signals are each "L" level, the OR 68 provides an output signal of "L" level to an input terminal R of the 60-base counter 69. The 60-base counter 69, therefore, is not reset and counts the time signal P66 supplied from the AND 67 to an input terminal I of the 60-base counter 69 at one-minute interval. After counting the time signal P66 sixty times, i.e., after one hour, an output terminal Q of the 60-base counter 69 provides a one-hour signal P69.

The usual dual time signal generating circuit 70 provides a usual dual time signal P70 of one-hour interval according to the timing of the one-hour signal P69 and predetermined one of the frequency-divided signals P51. The signal P70 is supplied to the dual time hand driving circuit 111 to drive the dual time hand 7 for a one-hour portion. The usual dual time signal P70 is also provided to one input of the OR 120 of the date shifting detecting circuit 118. The OR 120 provides the usual dual time signal P70 to the terminal U of the 24-base counter 125 and to one input of the AND 130.

When the 24-base counter 125 becomes zero, the zero count detecting circuit 126 provides the signal P126 of "H" level, so that the AND 130 provides a signal P130 of "H" level. The signal P130 is supplied to one input of the AND 86 of the date controlling circuit 74. Other two inputs of the AND 86 receive the inverted crown-second-pulled-position signal P63 and inverted crown-first-pulled-position signal P64, respectively. Since the signals P63 and P64 are each "H" level when the crown 21 is at the non-pulled position, the AND 86 provides the signal P130. Accordingly, the date advance signal generating circuit 88 provides a signal P88 for advancing the date by one day. The signal P88 is supplied to the date hand driving means 132 to advance the date by one day, thereby displaying the date corresponding to the dual time.

Similarly, when the 24-base counter 125 counts 23, the 23rd count detecting circuit 127 provides the signal P127 to one input of the AND 131. The other input of the AND 131 receives an output of the AND 75 of the area selecting circuit 72. Here, the AND 75 receives, as its first and second inputs, the inverted crown-second-pulled-position signal P63 and inverted crown-first-pulled-position signal P64, and as a third input, the first push signal P60. Since the first and second input signals P63 and P64 are each of "H" level with the crown 21 being at the non-pulled position, the AND 75 provides the third input signal P60 of "L" level to the dual time return signal generating circuit 77, which does not output the count signal C77 because the supplied signal P60 is of "L" level. As a result, the other input of the AND 131 receives a signal of "L" level, so that the AND 131 provides no output.

Next, an operation of the drive controlling circuit 71 with the crown 21 being at the non-pulled position will be explained. This operation is most important in this embodiment.

Firstly, an operation of the area selecting circuit 72 will be explained.

When the area selecting button 18 is pushed, the AND 75 receives, as its first and second input signals, the inverted crown-second-pulled-position signal P63 and inverted crown-first-pulled-position signal P64 each of "H" level from the switching circuit 52. Accordingly, the AND 75 provides a third input signal, i.e., the first push signal P60 supplied from the switching circuit 52.

According to the timing of the first push signal P60 from the AND 75 and predetermined one of the frequency-divided signals P51, the area change signal generating circuit 76 generates an area change signal P76 which is a two-shot signal (an interval between two pulses of the two-shot signal is about 30 ms) for driving the area indicating hand 5 twice in the normal rotating direction. The signal P76 is supplied to the terminal U of the 48-base counter 122 of the date shifting detecting circuit 118, and the 48-base counter 12 increases its count by two. The signal P76 is also supplied to the area indicating hand driving means 104. Accordingly, if the area indicating hand 5 is indicating the normal time scale of a certain area, the hand 5 moves to the normal time scale 12 of the next area. On the other hand, if the area indicating hand 5 is indicating the summer time scale 11 of a certain area, the hand 5 moves to the summer time scale of the next area. For the eyes of the user, these movements of the hand 5 in changing the areas are instantaneous. At this time, the normal time and the summer time are not switched from one to the other. Accordingly, it is not necessary to adjust the mode controlling circuit 114.

According to the timing of the first push signal P60 from the AND 75 and predetermined one of the frequency-divided signals P51, the dual time return signal generating circuit 77 provides a dual time return signal P77 for driving the dual time hand 7 once in a reverse rotating direction. The signal P77 is supplied to the dual time hand driving means 109, which once moves the dual time hand 7 once in the reverse rotating direction, thereby following the area indicating hand 5 that has been moved to the next area on the west side. As a result, the dual time is delayed by one hour. At this time, the dual time return signal generating circuit 77 provides a count signal C77 together with the dual time return signal P77. The count signal C77 is supplied to the terminal D of the 24-base counter 125 of the date shifting detecting circuit 118 to reduce the count of the counter 125 by one.

Next, an operation of the normal/summer switching circuit 73 will be explained. Under a summer time function selected state with the crown 21 being at the non-pulled position, the normal/summer switching button 19 is pushed. The AND 78 receives, as its first, second and third input signals, the inverted crown-second-pulled-position signal P63 and inverted crown-first-pulled-position signal P64 from the switching circuit 52 and the summer mode signal P116 from the mode controlling circuit 114. These signals are each of "H" level. The AND 78 provides, therefore, its fourth input signal, i.e., the second push signal P61 supplied from the switching circuit 52.

According to the timing of the second push signal P61 from the AND 78 and predetermined one of the frequency-divided signals P51, the normal shift signal generating circuit 79 outputs a normal shift signal P79 which is a one-shot signal for driving the area indicating hand 5 once in the normal turning direction.

The signal P79 is supplied to the area indicating hand driving means 104 to drive the area indicating hand 5 once in the normal turning direction. As a result, the hand 5 moves from the summer time scale 11 to the normal time scale 12 of the same area. At the same time, the normal shift signal P79 is supplied to the input terminal U of the 48-base counter 122 of the date shifting detecting circuit 118 to increase the count of the counter 122 by one. Further, the normal shift signal P79 is supplied to the mode controlling circuit 114 to invert the binary counter 116, thereby providing the normal mode signal P117 instead of the summer mode signal P116 to change the mode.

According to the timing of the second push signal P61 from the AND 78 and predetermined one of the frequency-divided signals P51, the dual time return signal generating circuit 80 provides a dual time return signal P80 for driving the dual time hand 7 once in the reverse turning direction. The signal P80 is supplied to the dual time hand driving means 109 to drive the dual time hand 7 once in the reverse turning direction, thereby following the area indicating hand 5 that has been moved to the normal time scale 12. As a result, the dual time is delayed by one hour. The dual time return signal generating circuit 80 provides an inverted count signal C80 together with the dual time return signal P80. The count signal C80 is supplied to the input terminal D of the 24-base counter 125 of the date shifting detecting circuit 118 to reduce the count of the counter 125 by one.

Under a normal time function selected state with the crown 21 being at the non-pulled position, the normal/-summer switching button 19 is pushed. Then, the AND 81 receives, as its first, second and third input signals, the inverted crown-second-pulled-position signal P63 and inverted crown-first-pulled-position signal P64 from the switching circuit 52 and the normal mode signal P117 from the mode controlling circuit 114. These input signals are each "H" level. Accordingly, the AND 81 provides a fourth input signal, i.e., the second push signal P61 supplied from the switching circuit 52.

According to the second push signal P61 from the AND 81 and predetermined one of the frequency-divided signals P51, the summer time shift signal generating circuit 82 provides a summer time shift signal P82 which is a one-shot signal for driving the area indicating hand 5 once in the reverse turning direction. The signal P82 is supplied to the area indicating hand driving means 104, which drives the area indicating hand 5 once in the reverse turning direction. Accordingly, the area indicating hand 5 is moved from the normal time scale 12 to the summer time scale 11 of the same area. In synchronization with the summer time shift signal P82, the summer time shift signal generating circuit 82 provides an inverted count signal C82 which is a one-shot signal. The count signal C82 is supplied to the input terminal D of the 48-base counter 122 of the date shifting detecting circuit 118 to decrease the count of the counter 122 by one.

The inverted count signal C82 is also supplied to the mode controlling circuit 114 to invert the binary counter 116, thereby providing the summer mode signal P116 instead of the normal mode signal P117 to change the mode.

According to the timing of the second push signal P61 from the AND 81 and predetermined one of the frequency-divided signals P51, the dual time advance signal generating circuit 83 provides a dual time advance signal P83 for once driving the dual time hand 7 in the normal turning direction. The signal P83 is supplied to the dual time hand driving means 109, which once drives the dual time hand 7 in the normal turning direction, thereby following the area indicating hand 5 that has been moved to the summer time scale 11. As a result, the dual time is advanced by one hour. The dual time advanced signal P83 is also supplied to the input terminal U of the 24-base counter of the date shifting detecting circuit 118 to increase the count of the counter 125 by one.

Next, a date changing operation of the invention will be explained.

Figure 3:
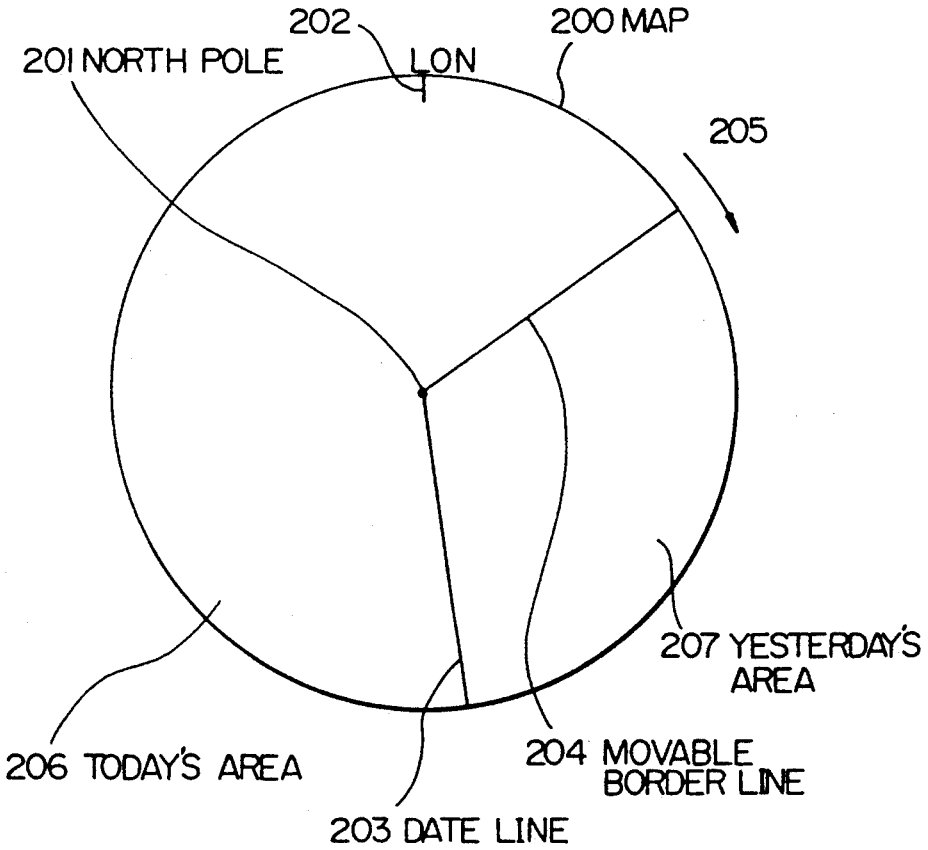
FIG. 3 is a view explaining relations of the International Date Line to a movable border line according to the present invention.

Relations of areas to dates will schematically be explained with reference to FIG. 3.

In the figure, numeral 200 denotes a map with the North Pole 201 at the center thereof, similar to the map of FIG. 1. The respective meridians are radially drawn from the North Pole. Geographical features of the map are omitted. Numeral 202 denotes an orientation of London (LON). Numeral 203 denotes the International Date line that fixedly exists between Midway (MDY) and Auckland (AKL). Numeral 204 denotes a movable border line between an area whose local time is 2400 hours something, i.e., zero hours AM something and an area whose local time is 2300 hours something, i.e., 1100 hours PM something. The movable border line 204 turns in the direction of an arrow mark 205. Namely, it turns westward around the earth once per 24 hours. Numeral 206 denotes a today's area which is on the west side of the Date Line 203 and on the east side of the movable border line 204. The area 206 has a single date, for example, today. The remaining area excluding the today's area 206 is a yesterday's area 207 whose date is one day before that of the today's area.

Angles of the two sector areas 206 and 207 increase or decrease according to elapsing time. Just after the movable border line 204 crossed the Date Line 203, the today's area 206 is very small, and the yesterday's area 207 is the great majority. As time passes in a single day, the today's area 206 increases its ratio, and when the movable border line 204 (a zero hour line) reaches the Date Line 203 again, the today's area 206 becomes the great majority. When the movable border line 204 crosses the Date Line 203, a one day ahead area, i.e., a new today's area is formed, and the old today's area becomes a new yesterday's area.

The date of a certain area on the earth may change when:

(1) The local standard time or the local summer time of the area reaches zero hours AM.

(2) Another area is selected across the International Date Line to the west or to the east.

A change in the date is always one day, and an increase or a decrease of the date depends on the crossing direction in the case of above (2). The present invention controls the above conditions with use of logic circuits and indicates a correct date. Taking the above conditions into account, the respective hands of the watch of the present invention are controlled according to the following rules:

(1) When the dual time hand 7 crosses a 2400 hours scale in the normal turning direction due to naturally elapsing time or a manual operation, a date is advanced by one day.

(2) When the dual time hand 7 crosses the 2400 hours scale in the reverse turning direction, the date is delayed by one day.

(3) When the area indicating hand 5 crosses the International Date Line in a westward turn, the date is advanced by one day.

(4) When the area indicating hand 5 crosses the International Date Line in an eastward turn, the date is delayed by one day.

Operations of the circuits of the present invention satisfy the above rules. In this embodiment, the area indicating hand 5 may be turnable in both the east and west directions, or in one of the directions. Operations of the date shifting detecting circuit 118 and related circuits will be explained.

With the crown 21 being at the non-pulled position, each of the ANDs 86 and 87 of the date controlling circuit 74 receives, as first and second inputs, the inverted crown-second-pulled-position signal P63 and inverted crown-first-pulled-position signal P64 each of "H" level. Accordingly, the AND 86 provides signals supplied from the ANDs 128 and 130 of the date shifting detecting circuit 118, while the AND 87 provides signals supplied from the ANDs 129 and 131. The 48-base counter 122 changes its count in response to signals supplied to its input terminals U and D and provides the count signal P122 from its output terminal Q.

When the count of the counter 122 reaches 23, namely, when the area indicating hand 5 reaches the summer time scale of AKL, the 23rd count detecting circuit 123 provides the detected signal P123 to one input of the AND 128. The other input of the AND 128 is, however, connected to the terminal U of the counter 122, so that the AND 128 provides the signal P123 only when the count of the counter 122 reaches the count 23 by an input to the terminal U. Namely, only when the area indicating hand 5 moves from MDY to AKL in the normal turning direction, the AND 128 provides the signal P123.

In other words, only when the area indicating hand 5 crosses the Date Line from the east to the west, the signal P123 is provided. With this signal, it is detected that the count of the 48-base counter 122 has changed from 22 to 23, and an operation of advancing the date is carried out.

Similarly, when the count of the 48-base counter 122 becomes 22, the 22nd count detecting circuit 124 provides the detected signal P124 to one input of the AND 129. The other input of the AND 129 is, however, connected to the terminal D of the counter 122, so that the AND 129 provides the detected signal P124 only when the count of the counter 122 becomes 22 by an input to the terminal D. Namely, only when the area indicating hand 5 moves from AKL to MDY, the AND 129 provides the signal P124.

This means that the signal P124 is provided only when the area indicating hand 5 crosses the Date Line from the west to the east. At this moment, it is detected that the count of the 48-base counter 122 changed from 23 to 22, and an operation of delaying the date is carried out.

When the count of the 24-base counter 125 reaches zero, the zero count detecting circuit 126 provides the detected signal P126 to one input of the AND 130. The other input of the AND 130 is, however, connected to the terminal U of the 24-base counter 125, so that the AND 130 provides the detected signal P126 only when the count of the 24-base counter 125 reaches zero by an input to the terminal U, i.e., only when the dual time hand 7 moves from 2300 hours to 2400 hours. In a similar manner, when the count of the 24-base counter reaches 23, the 23rd count detecting circuit 127 provides the detection signal P127 to one input of the AND 131. At this time, if the count of the 24-base counter 125 reaches 23 by an input to the terminal D of the counter 125 to which the other input of the AND 131 is connected, the AND 131 provides the detected signal P127. The detected signals passed through the ANDs 128 to 131 under the abovementioned conditions are supplied to the date controlling circuit 74.

The date advance signal generating circuit 88 follows the detected signal from the AND 86 and predetermined one of the frequency-divided signals P51 and provides a date advance signal P88 which is a one-shot signal for once driving the date hand 6 in the normal turning direction. The signal P88 is supplied to the date hand driving means 132, which advances the date hand 7 by one day.

The date return signal generating circuit 89 follows the detected signal from the AND 87 and predetermined one of the frequency-divided signals P51, and provides a date return signal P89 for once driving the date hand 6 in the reverse turning direction. The signal P89 is supplied to the date hand driving means 132, which returns the date hand 7 by one day.

Namely, the date shifting detecting circuit 118 of this embodiment is a drive controlling circuit that acts when the counts of counting means for counting the numbers of driving signals for the area indicating hand and dual time hand reach respective predetermined values. The drive controlling circuit then generates driving signals for moving the date hand in the normal or reverse turning direction depending on an increase or a decrease of the counts. In other words, the date shifting detecting circuit 118 is a discrimination circuit means for judging whether a count was increasing or decreasing to reach the predetermined value.

EXAMPLE 2

A second embodiment according to the present invention will be explained. A feature of the second embodiment is an excluding function in displaying a date. This function excludes non-existing dates such as February 29, 30 and 31, and thirty-firsts in April, June, September and November.

Figure 4:
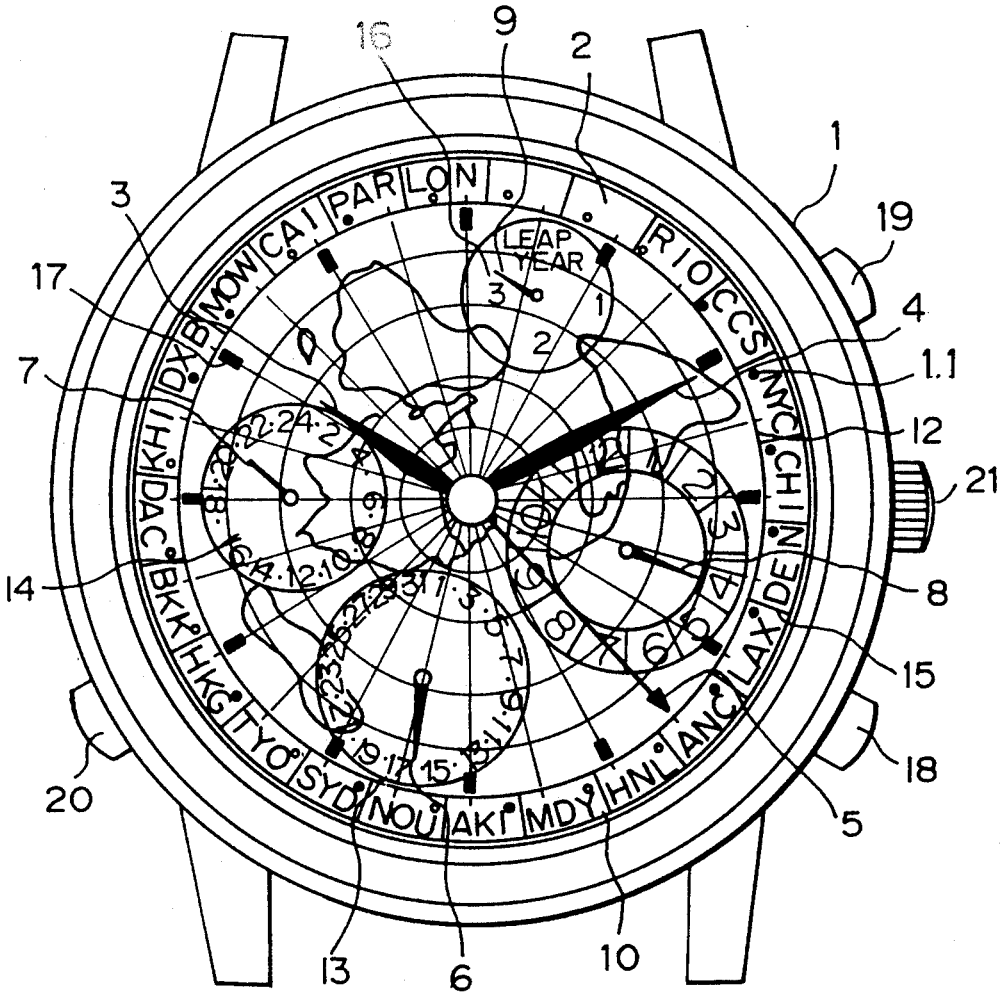
FIG. 4 is a front view showing the exterior of world watch according to a second embodiment of the present invention.

FIG. 4 is an external plan view showing an analog electronic watch having a date displaying function, a non-existing date excluding function and a world time synchronizing function. In the figure, the same parts as those of FIG. 1 are represented with identical reference marks.

On a dial 2, there are arranged hands and scales similar to those of the first embodiment, and in addition, a month hand 8 and month numerals 15 around a four o'clock position of the dial 2. Further, a year hand 9 is fitted to the dial 2 around a one o'clock position, and year symbols 16 are arranged around the year hand 9. These hands indicate the year, month, day and summer time or normal time of an area selected by an area indicating hand 5, by excluding the non-existing dates. Symbols LEAP YEAR, +1, +2 and +3 mean a leap year, one year after the leap year, two years after the leap year and three years after the leap year, respectively. Similar to the first embodiment, it is supposed that the International Date Line exists between AKL and MDY among regional name symbols 10. The year, month and date hands are synchronized through trains.

Figure 5:
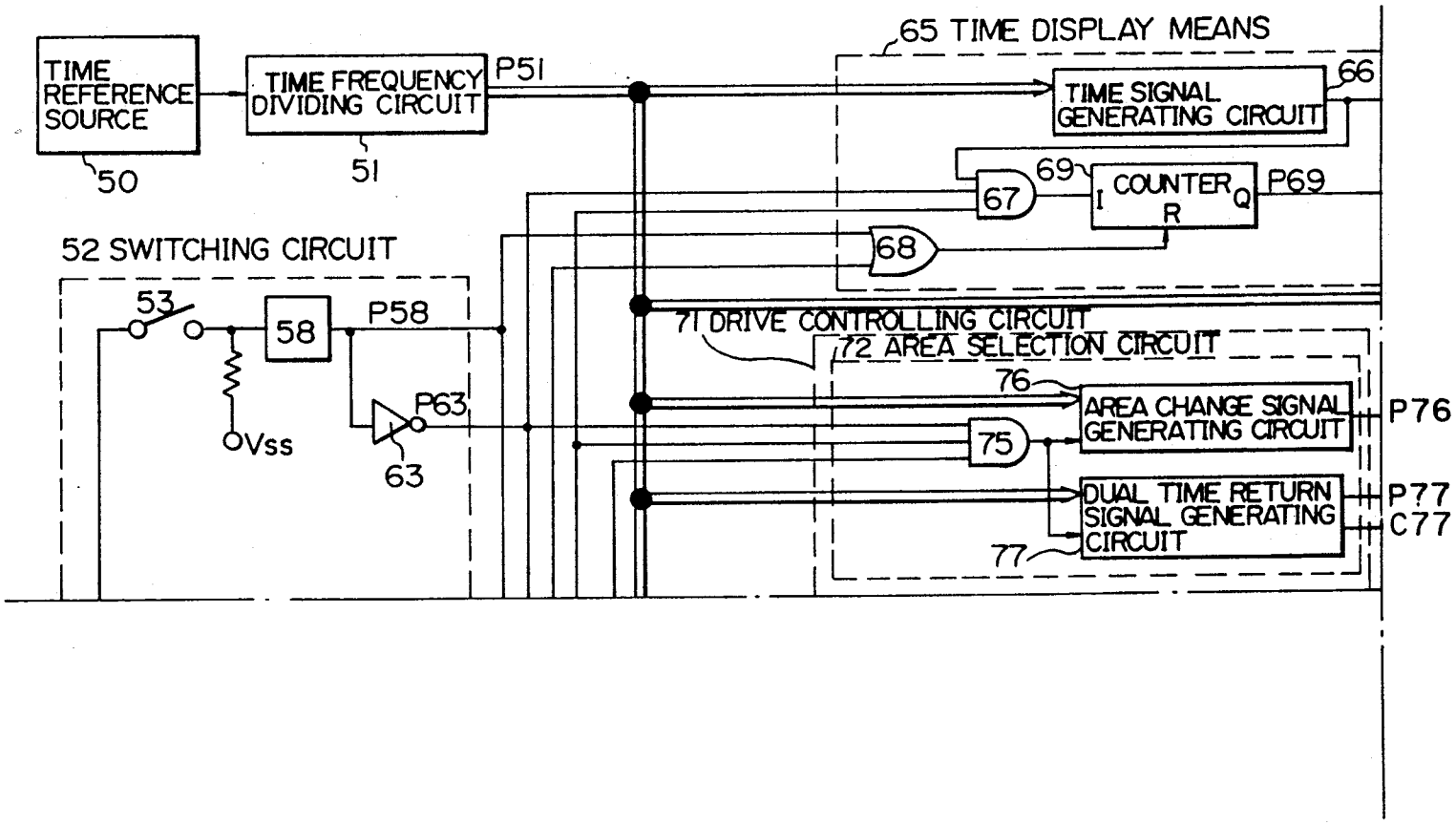
FIGS. 5A, 5B, 5C, 5D, 5E, and 5F when arranged as in FIG. 5 is a circuit block diagram showing the second embodiment of the present invention.
Figure 5B:
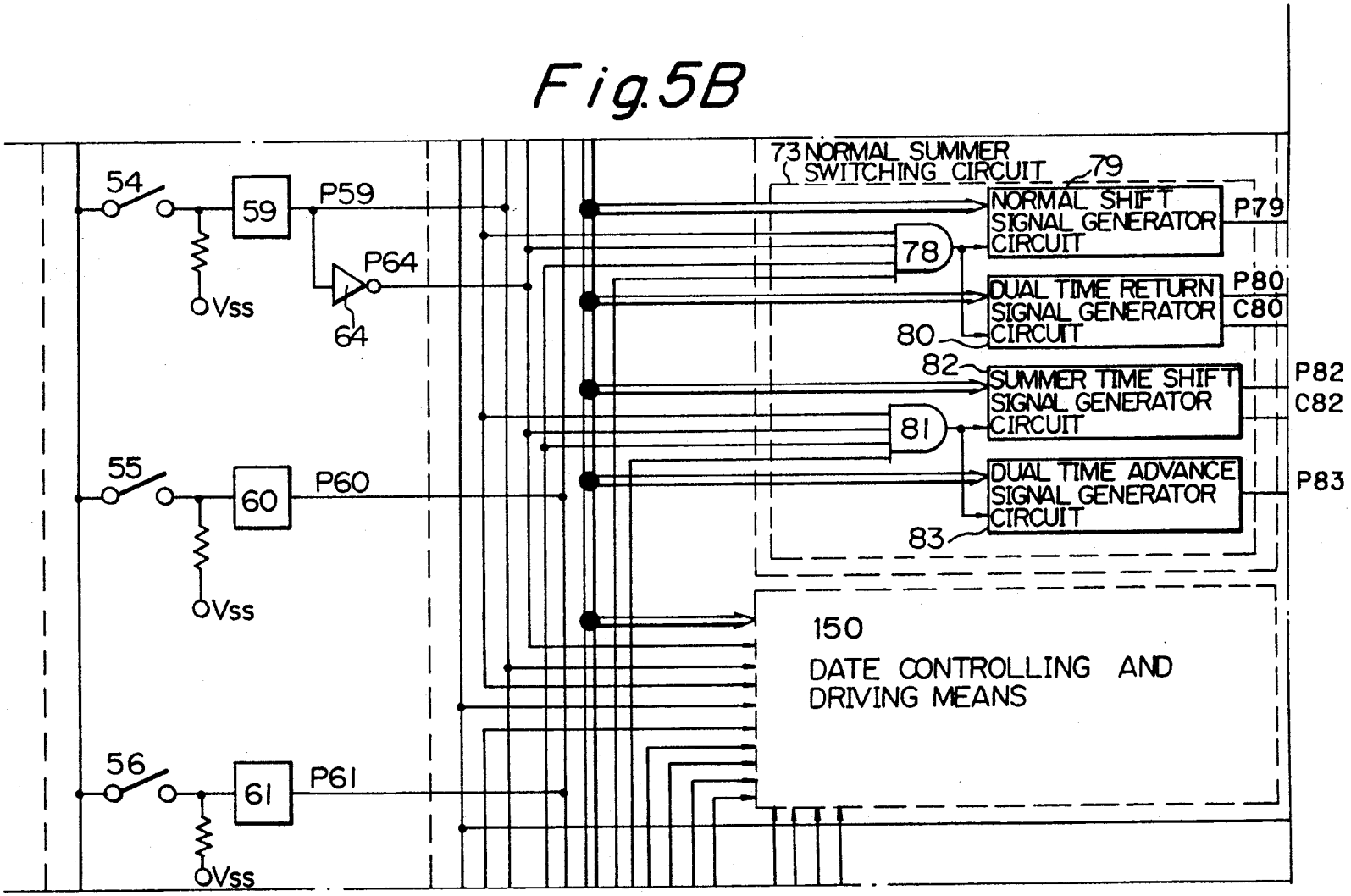
Figure 5C:
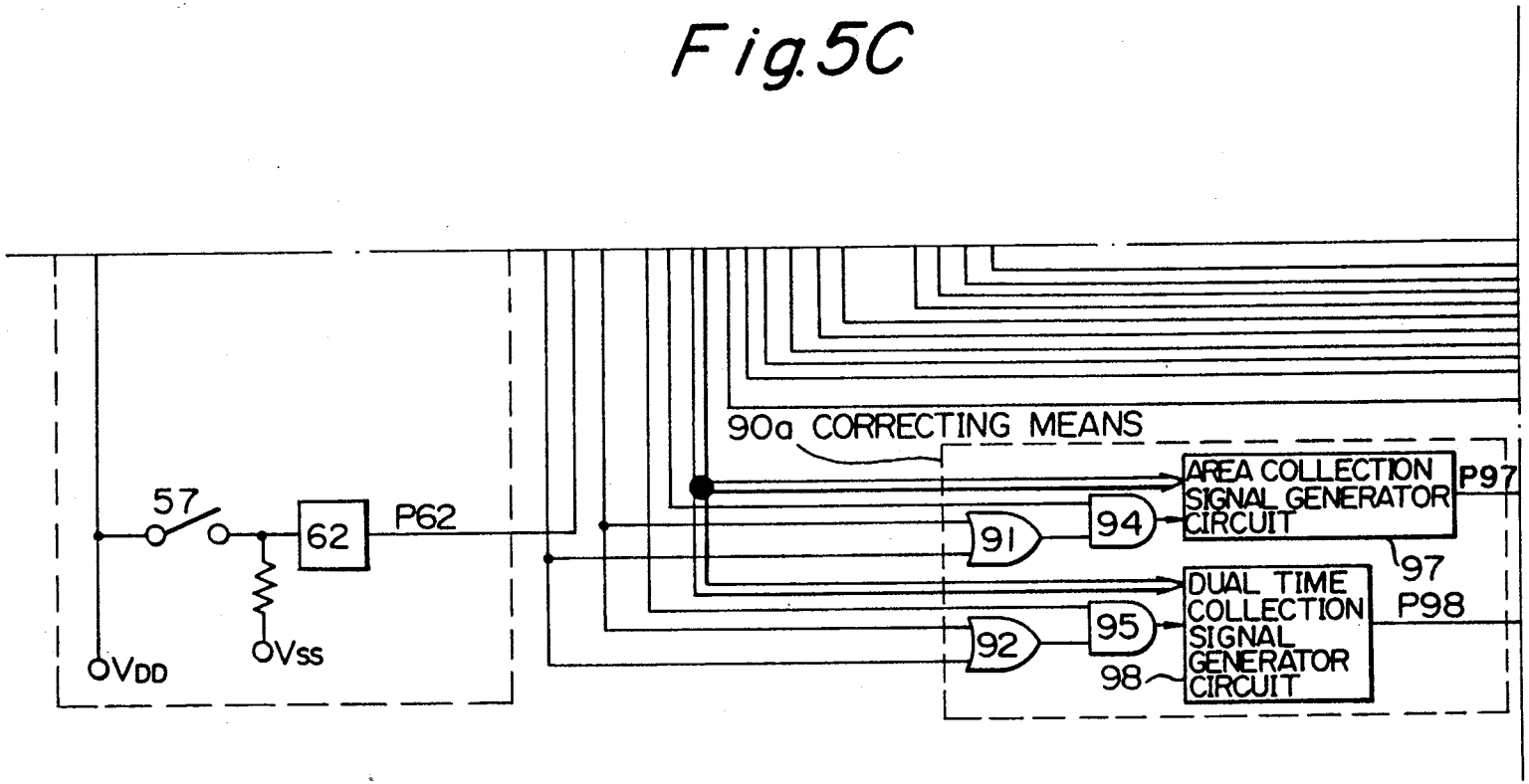
Figure 5D:
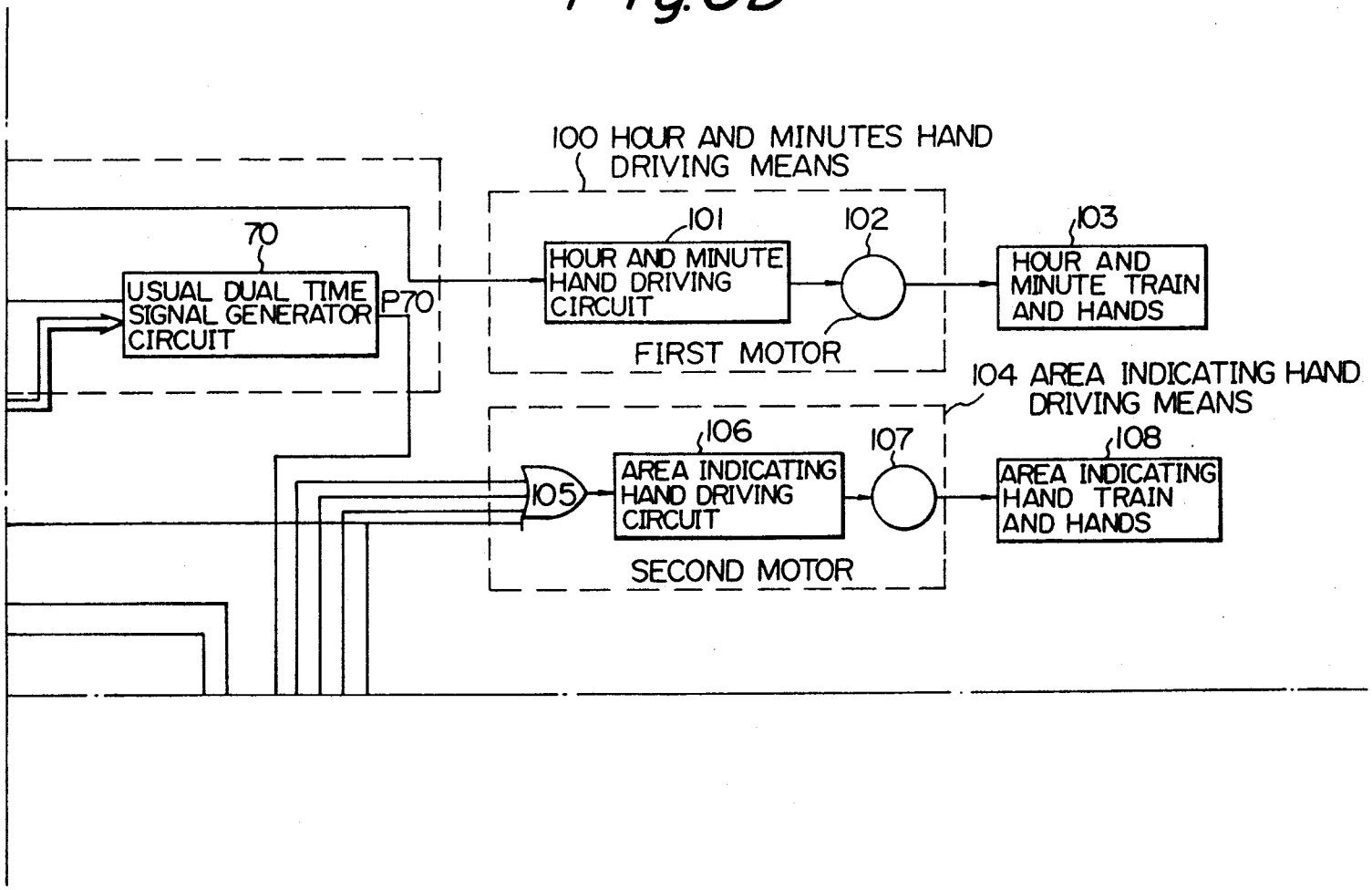
Figure 5E:
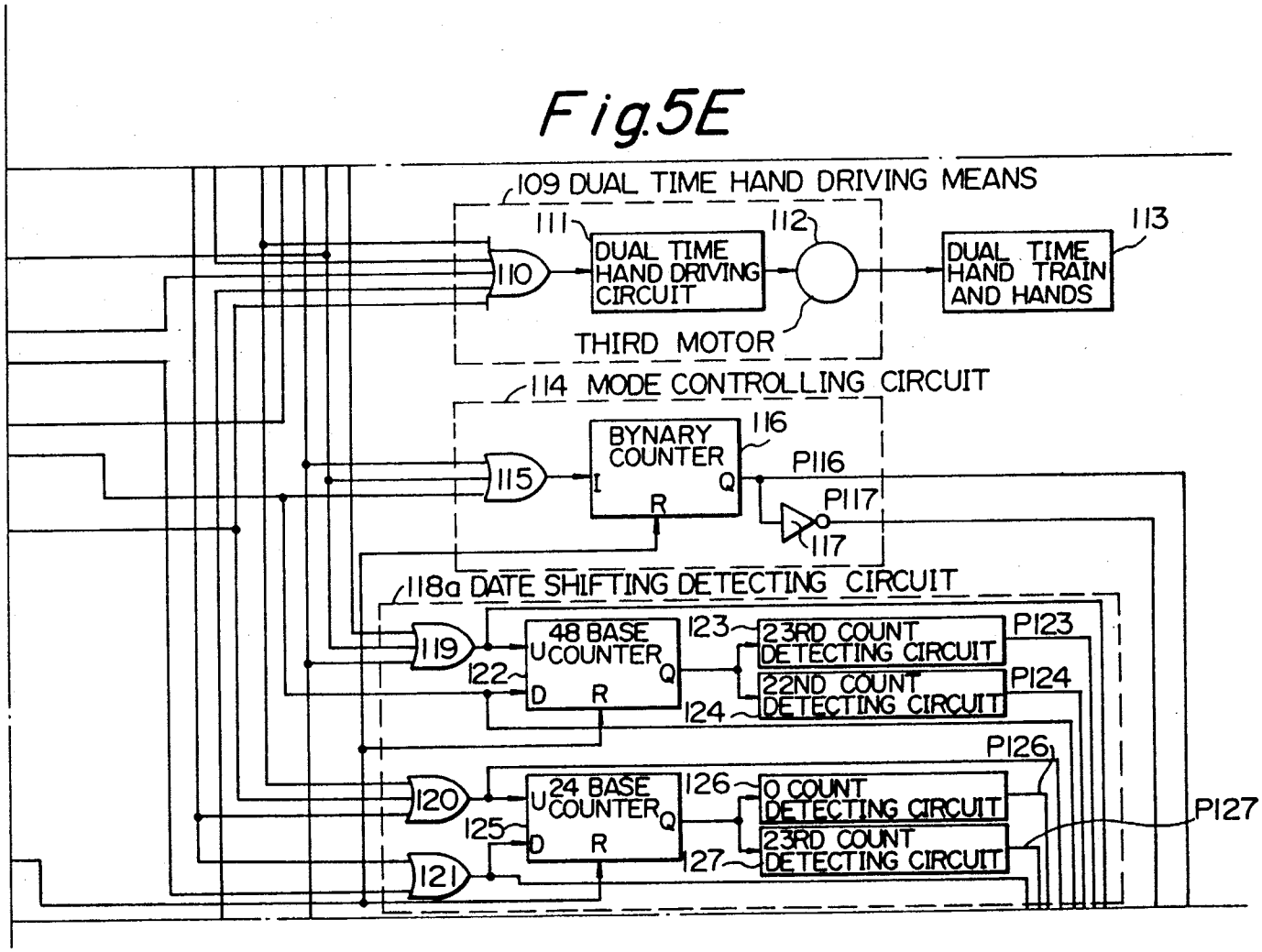
Figure 5F:
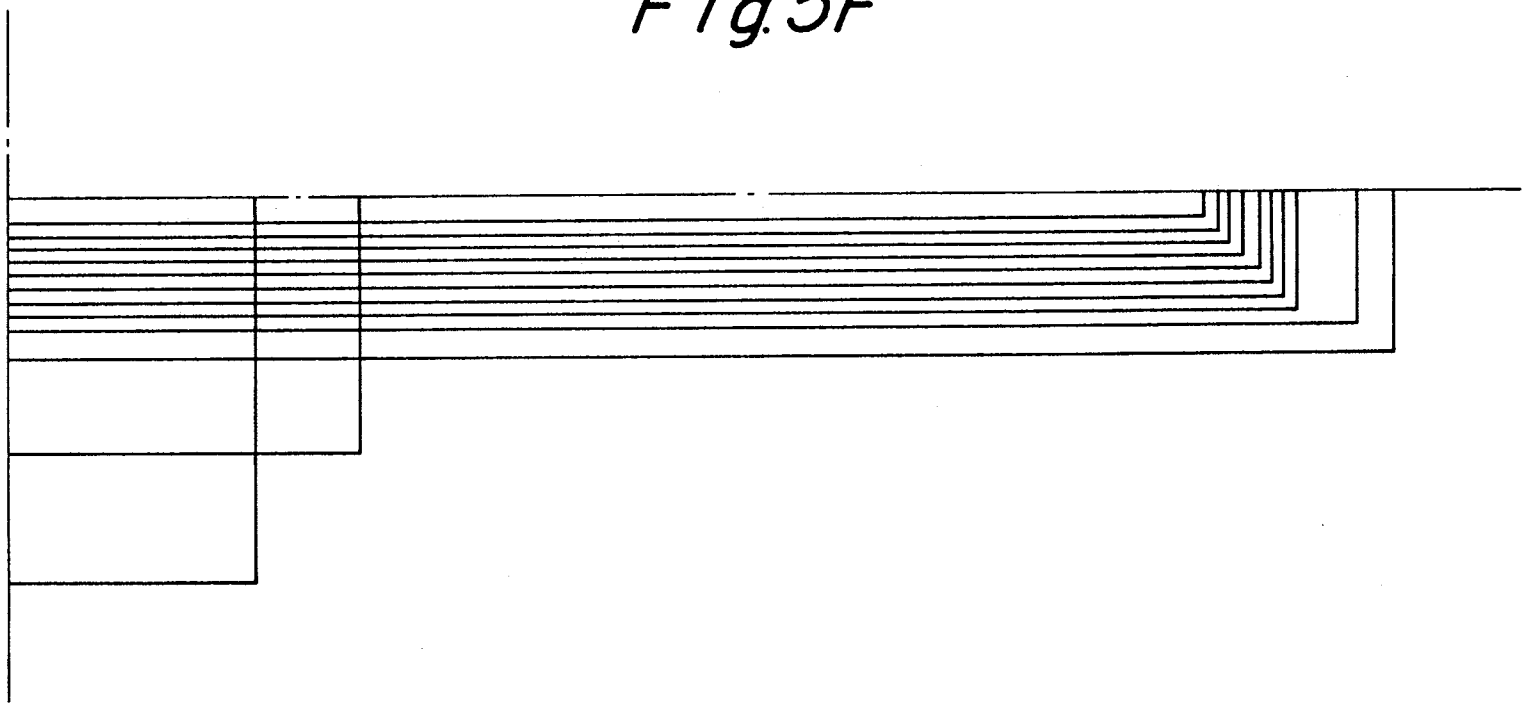
Figure 6A:
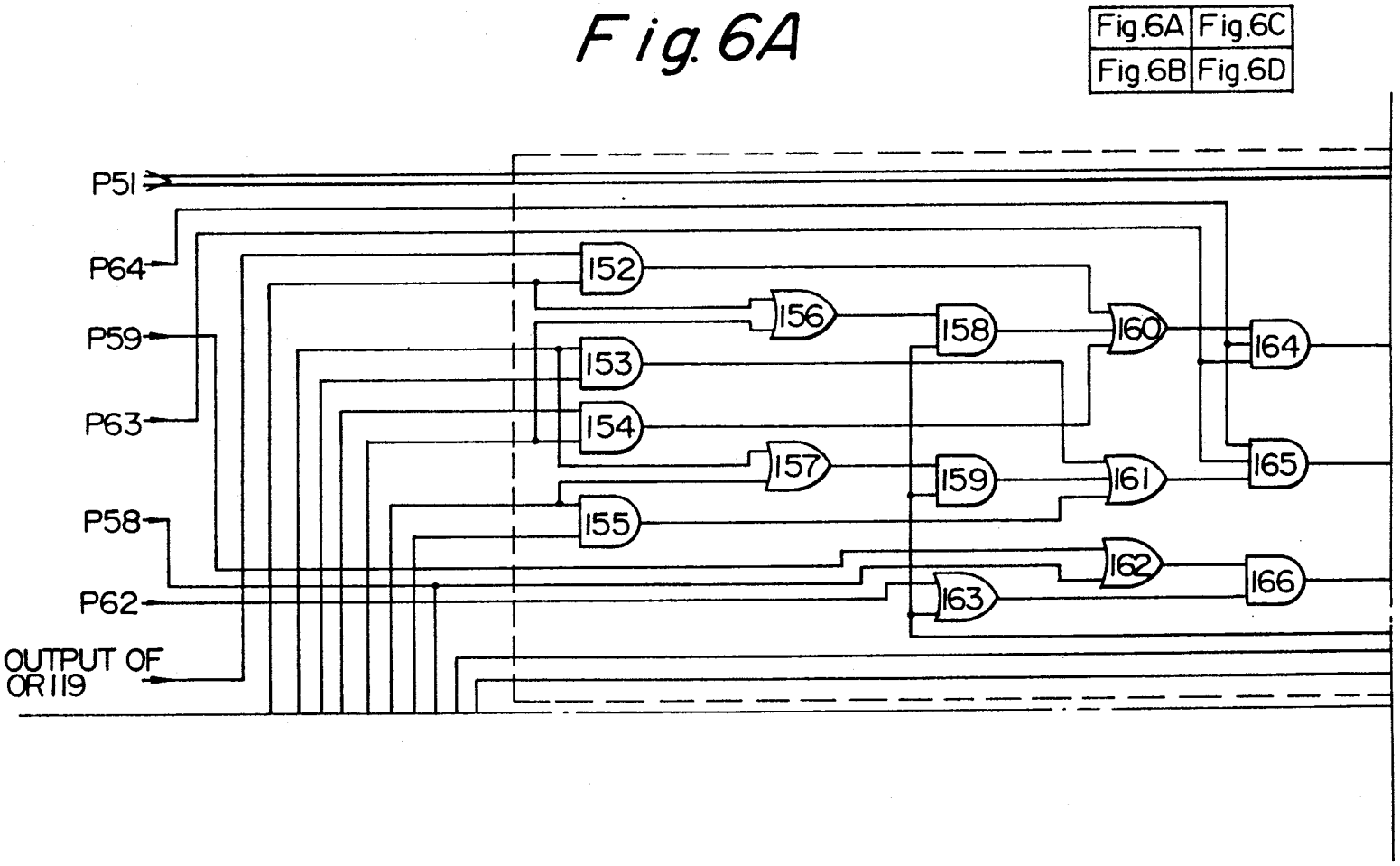
FIGS. 6A, 6B, 6C, and 6D when arranged as in FIG. 6 is a circuit block diagram showing a date controlling and driving means involved in the circuit diagram of FIG. 5A through 5D.
Figure 6B:
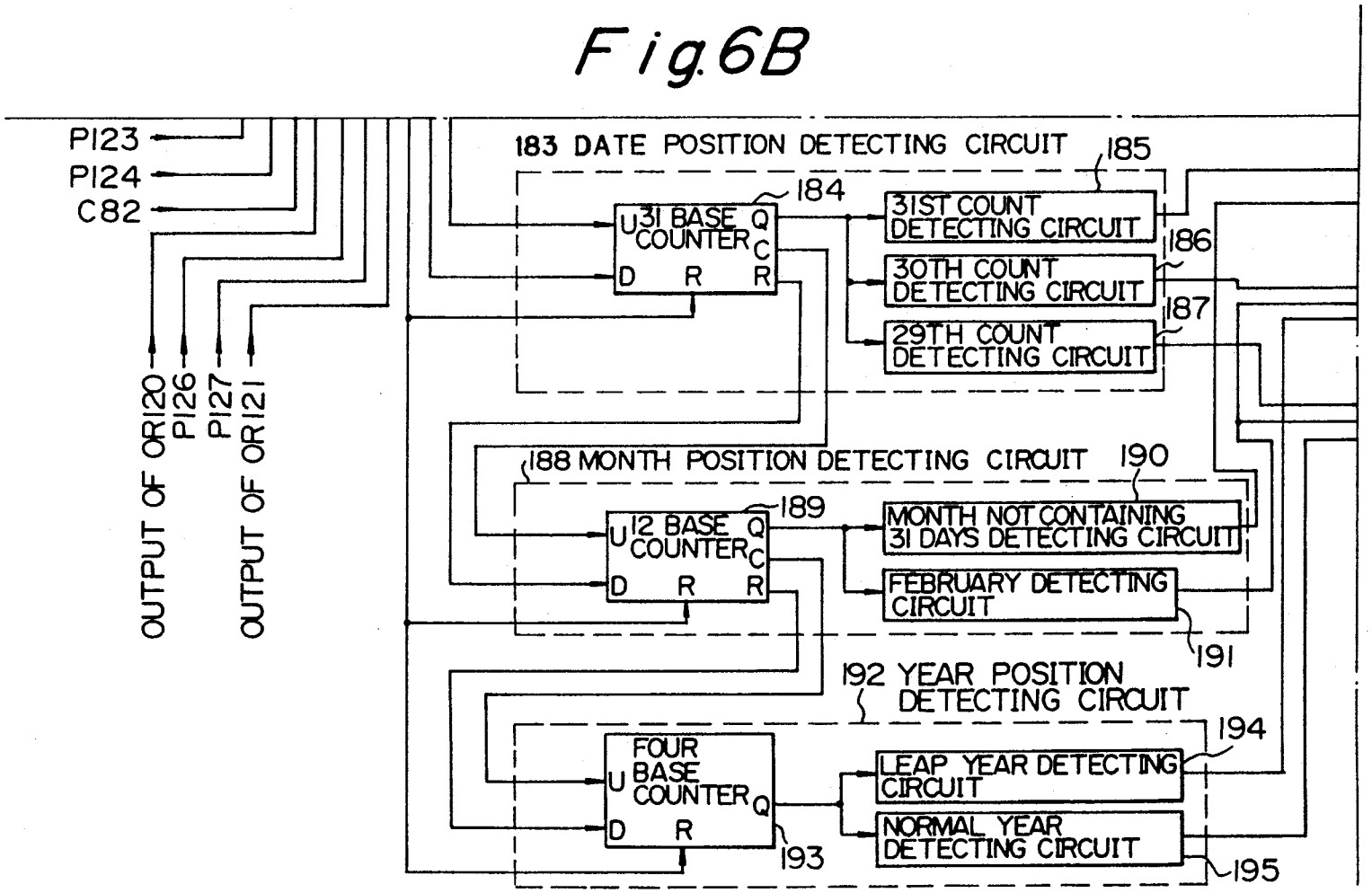
Figure 6C:
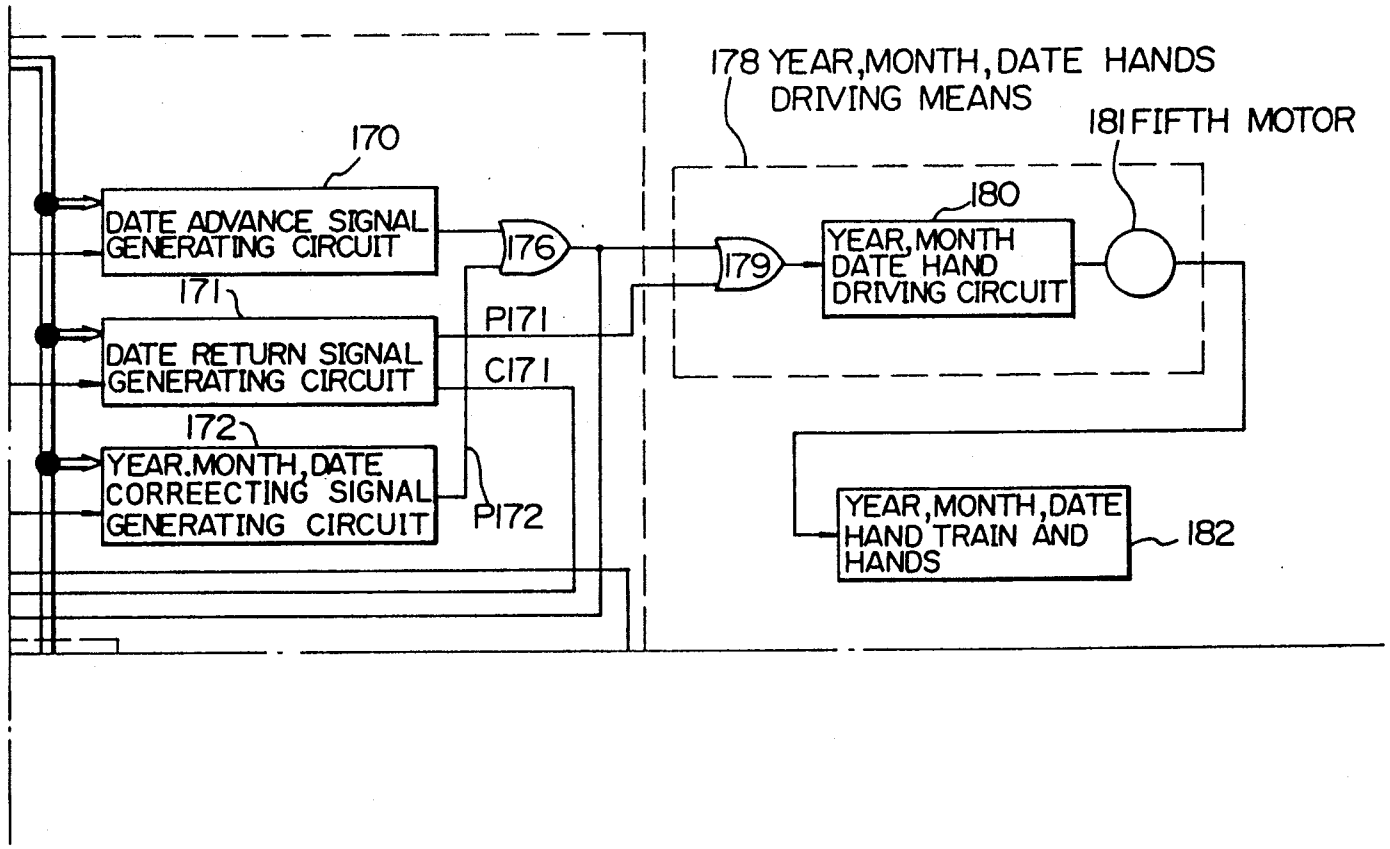
Figure 6D:
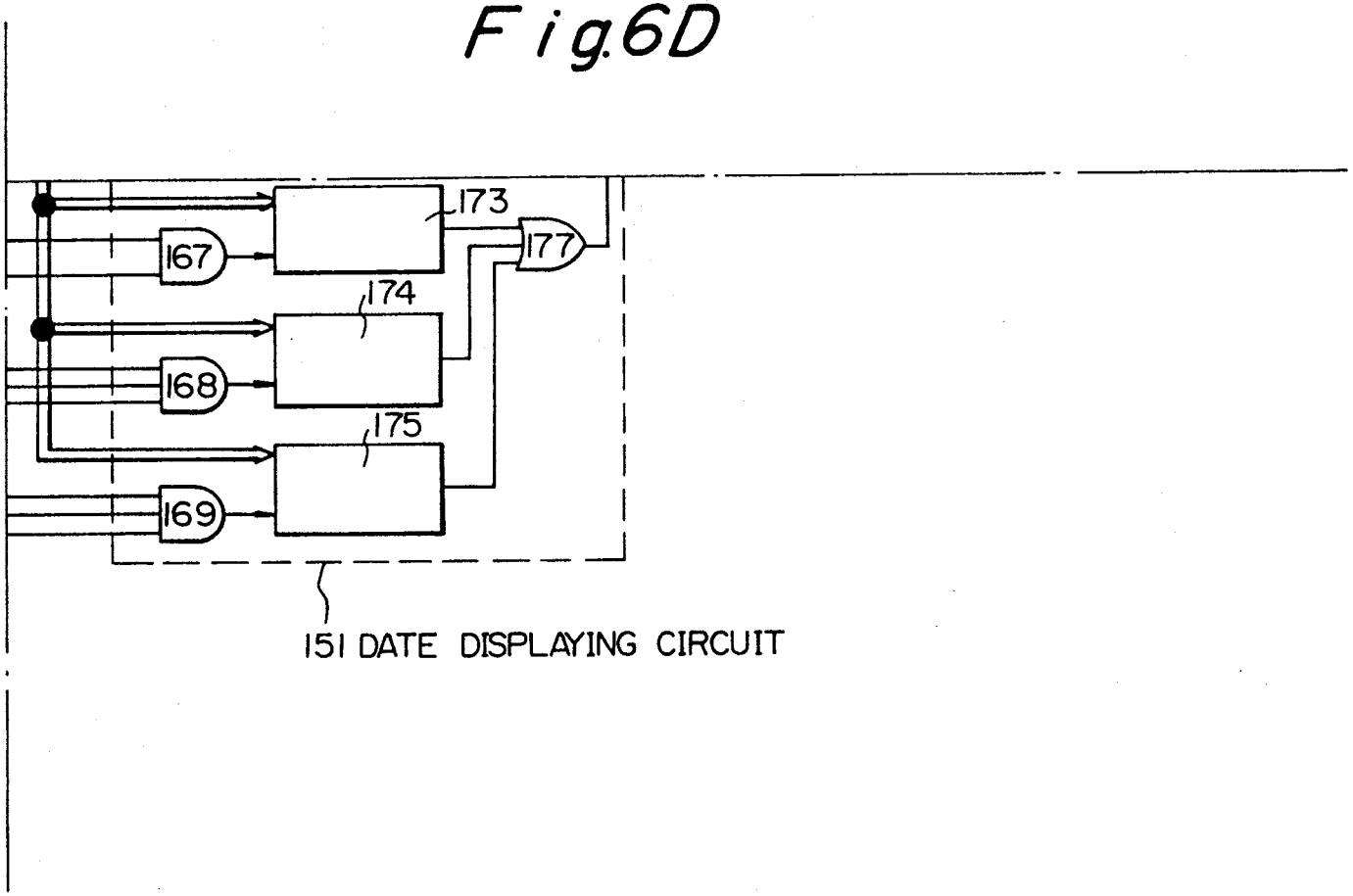

FIG. 5 is a circuit block diagram of the second embodiment shown in FIG. 4, and FIG. 6 is a circuit block diagram showing a date controlling and driving means 150 in the circuit block diagram of FIG. 5.

Among components of FIG. 5, those having the same functions as those of the components of FIG. 2 are represented with identical reference marks.

Compared with FIG. 2, the second embodiment is characterized in that a drive controlling means **71*a* comprises an area selecting circuit 72 and a normal/summer switching circuit 73, that the drive controlling means 71*a*, a correcting means 90*a* and a date shifting detecting circuit 118*a* differ from corresponding ones of FIG. 2, and that the date controlling and driving means 150 differs from the date controlling circuit of FIG. 2. The correcting means 90*a* resembles the correcting means 90 of FIG. 2 but does not have the OR 93, AND 96 and date correction signal generating circuit 99 of FIG. 2. The date shifting detecting circuit 118*a* resembles the date shifting detecting circuit 118 of FIG. 2 but does not have the ANDs 128 to 131 of FIG. 2**.

The date controlling and driving means 150 comprises, as shown in FIG. 6, a date displaying circuit 151; a year, month and date hands driving means 178; year, month and date hand trains and hands 182; a date position detecting circuit 183; a month position detecting circuit 188; and a year position detecting circuit 192.

The date displaying circuit 151 comprises ANDs 152 to 155, 158, 159 and 164 to 169; ORs 156, 157, 160 to 163, 176 and 177; a date advance signal generating circuit 170; a date return signal generating circuit 171; a year, month and date correcting signal generating circuit 172; and one-pulse generating circuits 173 to 175.

Operations of the circuit block diagrams of FIGS. 5 and 6 will be explained, According to this embodiment having the non-existing date excluding function, the year hand 9, month hand 8 and date hand 6 are initialized with a crown 21 being at a second pulled position. Other specifications of the second embodiment are the same as those of the first embodiment. Namely, under a normal using state with the crown 21 being at a non-pulled position, the dual time and date of an area optionally selected by an area indicating hand 5 are completely synchronized.

An operation of the second embodiment with the crown 21 being at the second pulled position will be explained.

Under this state, a time correction by an hour hand 3 and a minute hand 4 and an initialization of the area indicating hand 5 and a dual time hand 7 are carried out in manners similar to those of the first embodiment. To initialize the year hand 9, month hand 8 and date hand 6 with the crown 21 being at the second pulled position, a switching circuit 52 provides a third push signal P62. In the date displaying circuit 151, a crown-second-pulled-position signal P58 is supplied to one input of the OR 162 from which the signal P58 is supplied to one input of the AND 166. Another input of the AND 166 receives a third push signal P62 and provides the signal P62.

According to the timing of the third push signal P62 from the AND 166 and predetermined one of frequency-divided signals P51, the year, month and date correcting signal generating circuit 172 provides a year, month and date correcting signal P172 which is a one-shot signal for once driving the date hand 6. (The month hand 8 and year hand 9 are driven by the date hand 6 through the trains). The signal P172 is supplied to the year, month and date hands driving means 178, which once drives the date hand 6 (month hand 8, year hand 9) in a normal turning direction.

The date position detecting circuit 183, month position detecting circuit 188 and year position detection circuit 192 have a 31-base counter 184, a 12-base counter 189 and a four-base counter 193, respectively. These counters 184, 189 and 193 are reset by the crown-second-pulled-position signal P58 so that the detecting circuits 183, 188 and 192 may not be activated at all at this moment. For the initialization, a user may adjust the area indicating hand 5 to a normal time scale for LON on regional name symbols 10, the dual time hand 7 to "24" on dual time numerals 14, the year hand 9 to LEAP YEAR, the month hand 8 to a border between January and December of month numerals 15, and the date hand 6 to the first date "1". With this adjustment, the 31-base counter 184, 12-base counter 189 and four-base counter 193 are synchronized with the date hand 6, month 8 and year hand 9, respectively.

Next, an operation of the second embodiment with the crown 21 at a first pulled position will be explained.

Under this state, the area indicating hand 5 and dual time hand 7 may be corrected in the similar manners as those of the first embodiment. By pushing two buttons 18 and 19, the dual time of a required area may be adjusted, with taking summer time into account, if it is currently enforced in the area.

An operation of the date controlling and driving means 150 with the crown 21 being at the first pulled position will be explained.

It is supposed that the switching circuit 52 provides a third push signal P62. In the date displaying circuit 151, one input of the OR 162 receives a crown-first-pulled-position signal P59 and provides the same to one input of the AND 166. Another input of the AND 166 receives the third push signal P62. The AND 166 then provides the signal P62.

According to the timing of the third push signal P62 from the AND 166 and predetermined one of the frequency-divided signals P51, the year, month and date correcting signal generating circuit 172 provides a year, month and date correcting signal P172 which is a one-shot signal for once driving the date hand 6 in the normal turning direction. The signal P172 is supplied to the year, month and date hands driving means 178, which once drives the date hand 6 (month hand 8, year hand 9) in the normal turning direction. With the crown 21 at the first pulled position, the respective counters of the date position detecting circuit 183, month position detecting circuit 188 and year position detecting circuit 192 are not reset, so that the year, month and date correcting signal P172 is supplied to an input terminal U of the 31-base counter 184 to increase its count. When the count is changed to "1", an output terminal C of the 31-base counter 184 provides a carry signal to an input terminal U of the 12-base counter 189 whose count is then increased. When the count of the counter 189 is changed to "1", an output terminal C of the counter 189 provides a carry signal to an input terminal U of the four-base counter 193 whose count is then increased.

An output terminal Q of the 31-base counter 184 of the date position detecting circuit 183 provides its own count to a 31st count detecting circuit 185, 30th count detecting circuit 186 and 29th count detecting circuit 187. Similarly, an output terminal Q of the 12-base counter 189 provides its own count to a month not containing 31 days detecting circuit 190 and February provides its own count to a leap year detecting circuit 194 and normal-year detecting circuit 195. With these detecting circuits, the non-existing dates an be excluded in correcting the year, month and date of a specified area, with the crown 21 being at the first pulled position.

For example, with the crown 21 being at the first pulled position, it is supposed that a trial is made to set "February 31 of a leap year". By pushing a button 20, the year hand 9, month hand 8 and date hand 6 are adjusted in normal turning directions. For the "February 31 of the leap year", the 31-base detecting circuit 185 of the date position detecting circuit 183 provides a signal of "H" level to one input of the AND 167. The other input of the AND 167 receives an output of the month not containing 31 days detecting circuit 190 which is "H" level due to "February". Accordingly, the AND 167 provides a signal of "H" level to the one-pulse generating circuit 173. The one-pulse generating circuit 173 provides a signal similar to the third push signal P62 to the year, month and date correcting signal generating circuit 172, thereby once driving the date hand 6 in the normal turning direction. As a result, the date is set to "March 1 of the leap year". In this way, in setting year, month and day, the non-existing dates are excluded.

An operation with the crown 21 being at the non-pulled position and the non-existing date excluding function will be explained.

In this embodiment, the area changing and normal/-summer switching operations are the same as those of the first embodiment, and therefore, their explanations are omitted. Explanations will be made for the case of moving the area indicating hand 5 from MDY to AKL and the case of moving the dual time hand 7 from "23" to "24" or from "24" to "23". A first push signal P60 is supposed to be supplied to the area selecting circuit 72. Then, similar to the first embodiment, the area indicating hand 5 is moved from one area to the adjacent area on the west side. To follow this, the dual time hand 7 is delayed by one hour to reduce the count of a 24-base counter 125 of the date shifting detecting circuit 118*a* by one. If this makes the counter to reach a count of 23, a 23rd count detecting circuit 127 is activated to provide a signal P127 to one input of the AND 155 of the date displaying circuit 151. The other input of the AND 155 is connected to a terminal D of the 24-base counter 125 which provides, in this case, a signal of "H" level. Accordingly, the AND 165 provides the 23rd count detected signal P127 to the date return signal generating circuit 171.

According to the timing of the detected signal P127 and predetermined one of the frequency-divided signals P51, the date return signal generating circuit 171 provides a date return signal P171 for once driving the date hand 6 (year hand 9, month hand 8) in the reverse turning direction. With the signal P171, the year, month and date hands driving means 178 once drives the date hand 6 (year hand 9, month hand 8) in the reverse turning direction. Following the date return signal P171, the date return signal generating circuit 171 provides a one-pulse count signal C171 to an input terminal D of the 31-base counter 184 to decrease the count of the counter 184 by one. At this time, if the number of digits of the count is reduced, an output terminal B of the 31-base counter 184 provides a digit reduced signal to an input terminal D of the 12-base counter 189, thereby reducing the count of the counter 189 by one. At this time, if the number of digits of the count of the counter 189 is reduced, an output terminal B of the counter 189 provides a digit reduced signal to an input terminal D of the four-base counter 193, thereby reducing the count of the counter 193 by one.

If a non-existing date is produced by the above reductions in the counts, the respective one-pulse generating circuits 172 to 174 provide signals according to the respective detecting circuits, in a manner similar to that of the date setting operation with the crown 21 being at the first pulled position. One input of the AND 159 receives the detected signal P127 of the 23rd count detecting circuit 127, and the other input of the AND 159 receives a pulse for excluding the non-existing date. This pulse is supplied from the AND 159 to the date return signal generating circuit 171, which again provides a signal for once driving the date hand 6 (year hand 9, month hand 8) in the reverse turning direction.

In this way, according to the non-existing date excluding function, the date hand 6 turning in the normal direction skips the non-existing dates in the same direction, and when the date hand 6 is turning in the reverse direction, skips the non-existing dates in the reverse direction. Once a date is set, the date and dual time of a specified area are synchronized, and in addition, the date is completely synchronized when the area is changed, or when the area's normal time is changed to its summer time, or from the summer time to the normal time.

As described above, for the area changing operation by the area selecting button 18 and the normal time to summer time or the summer time to normal time switching operation by the normal/summer switching button 19 with the crown 21 at the non-pulled position, the date and dual time (world time) for normal time or summer time of a presently area are synchronized.

In the above two embodiments, the area indicating hand 5 is moved only westward from one area to the adjacent area. The detected signal P124 from the 22nd count detecting circuit 124, therefore, is not provided from the AND 129 or AND 153.

Even when the area indicating hand 5 is allowed to move eastward from one area to the adjacent area, it is not necessary to change the date shifting detecting circuits 118 and 118*a*.

EXAMPLE 3

Unlike the first embodiment, an area indicating hand 5 of a world watch of this embodiment can move in both the eastward and westward directions. An arrangement of the embodiment will be explained with reference to FIG. 7.

Figure 7B:
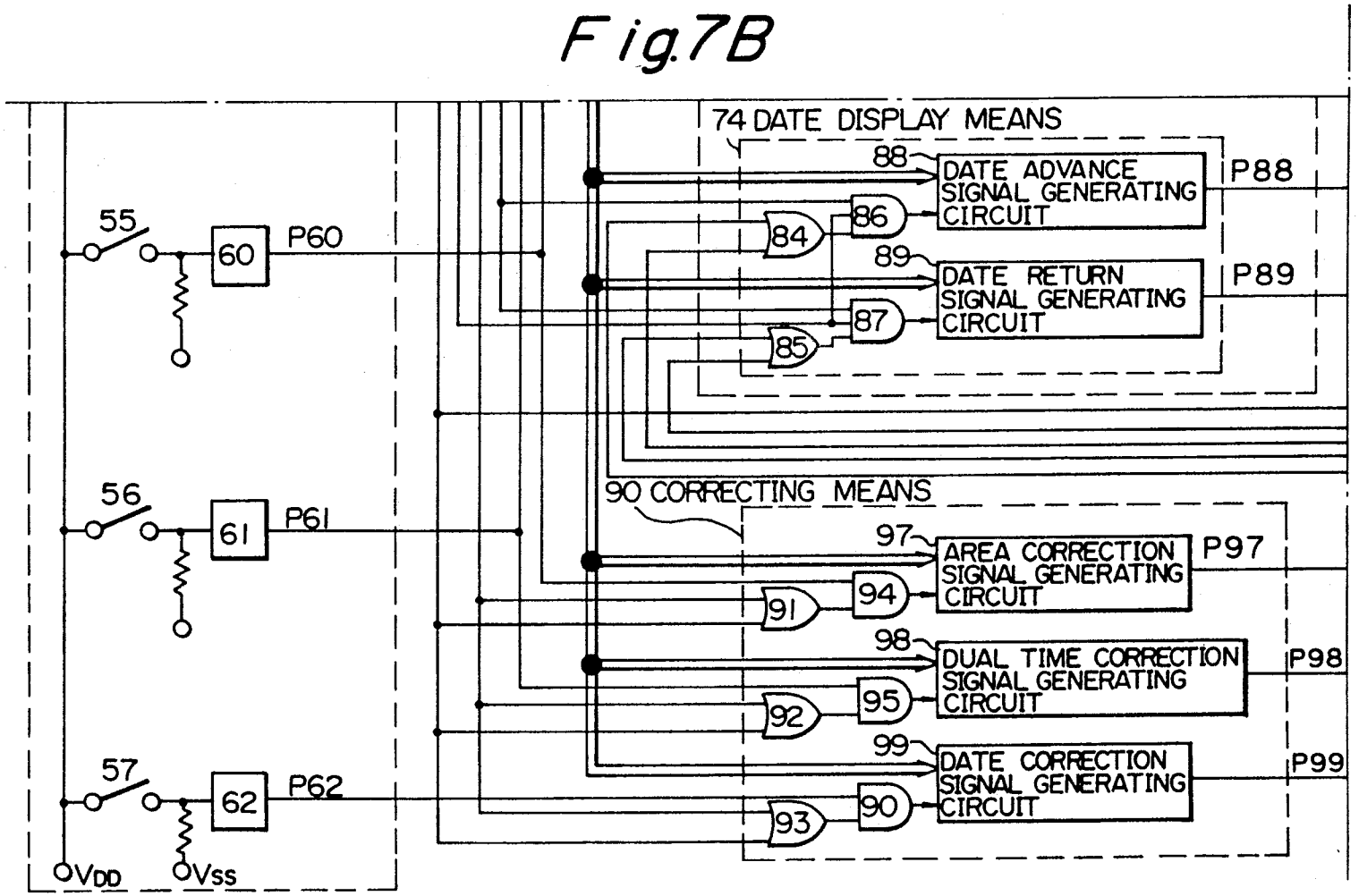
Figure 7C:
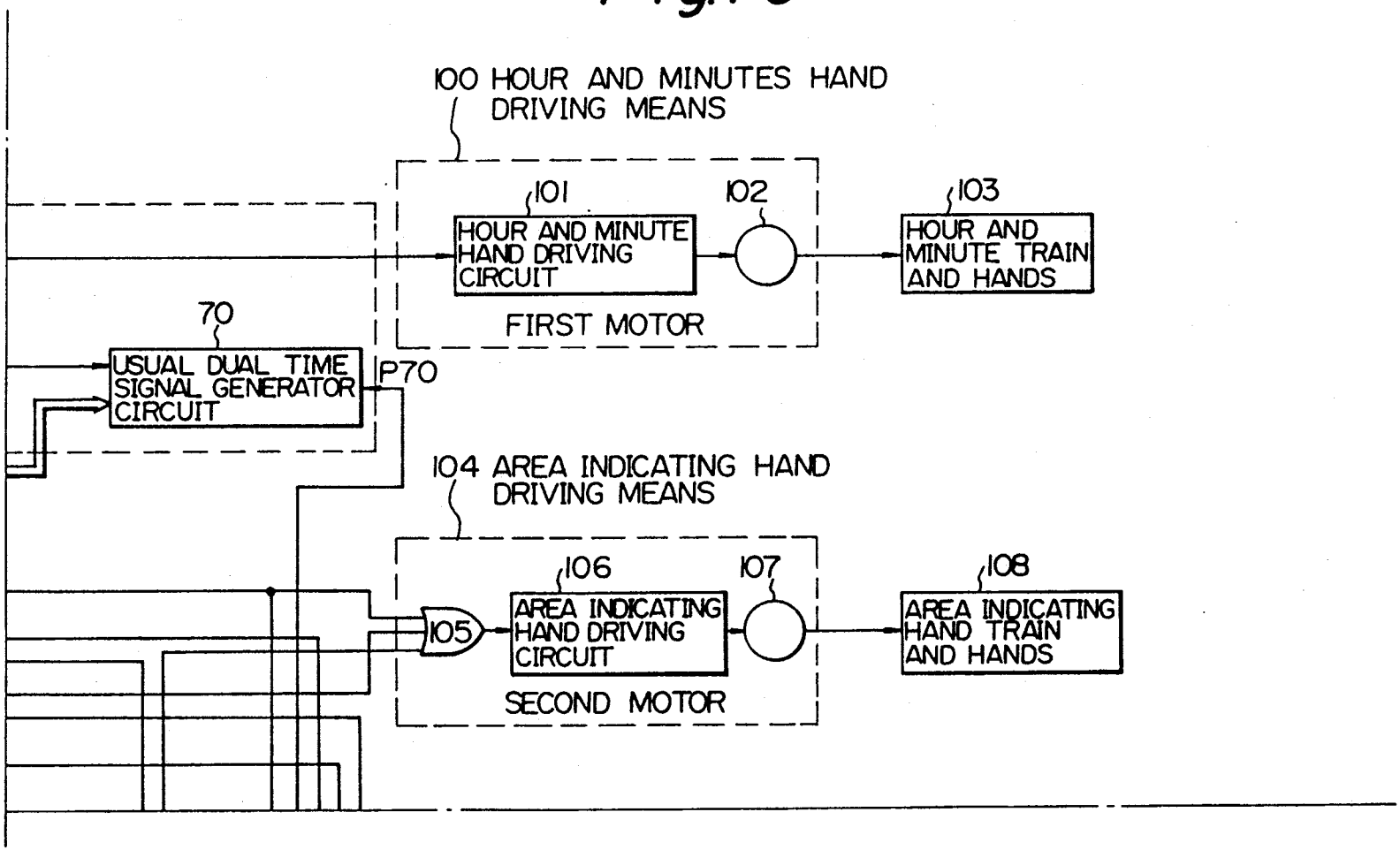
Figure 7D:
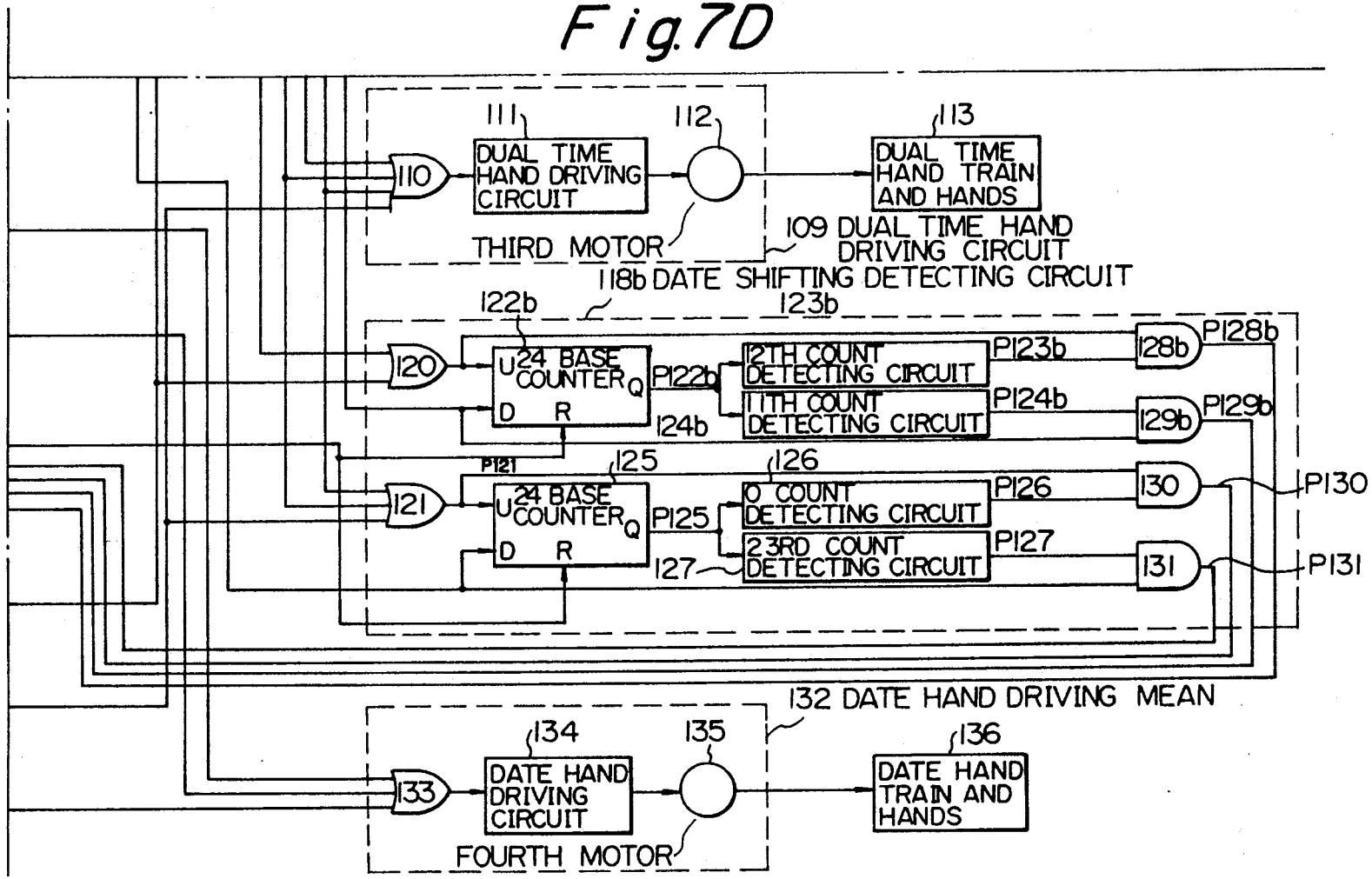
Figure 8A:
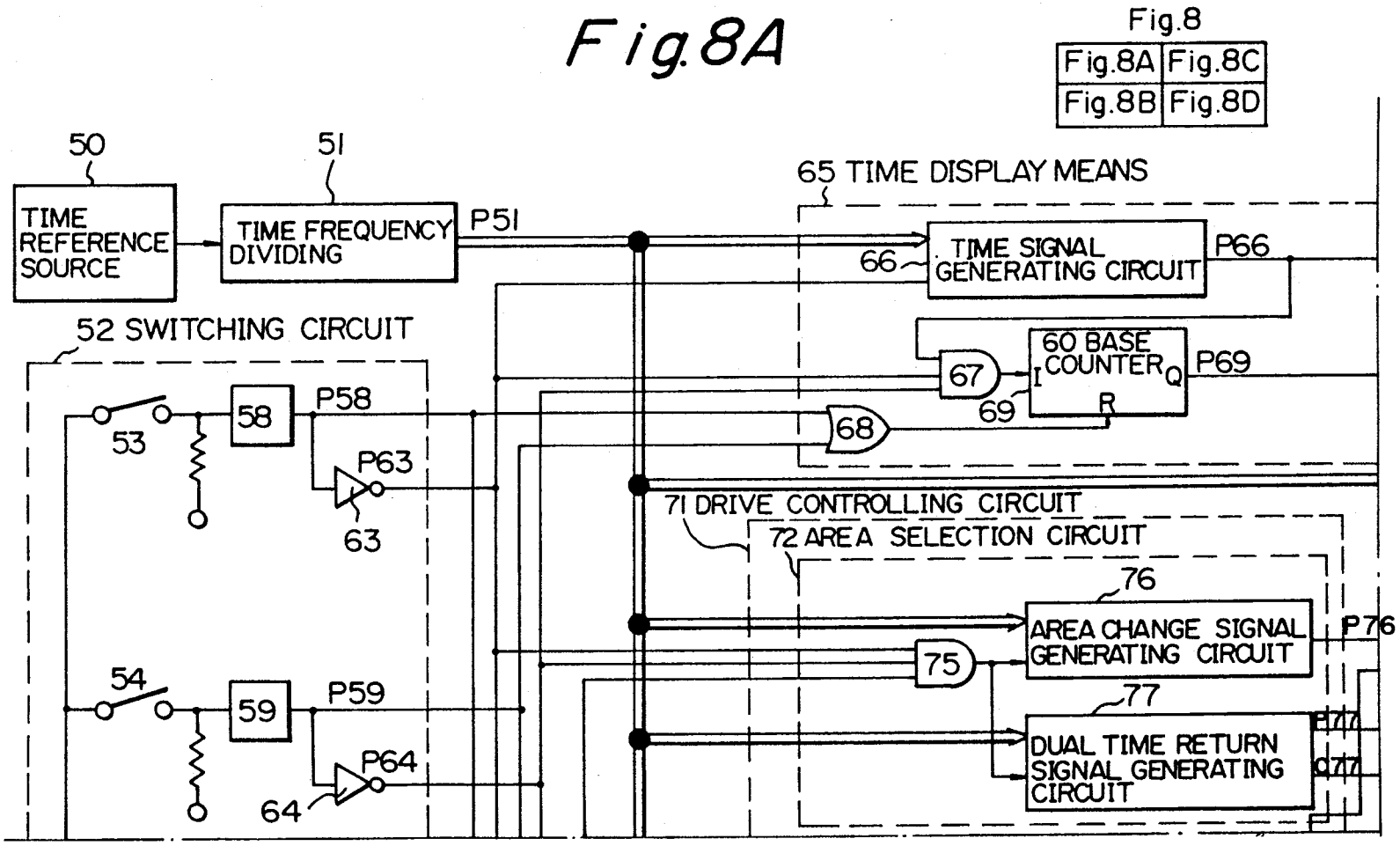
FIGS. 8A, 8B, 8C, and 8D when arranged as in FIG. 8 is a circuit block diagram showing a fourth embodiment of the present invention.
Figure 8B:
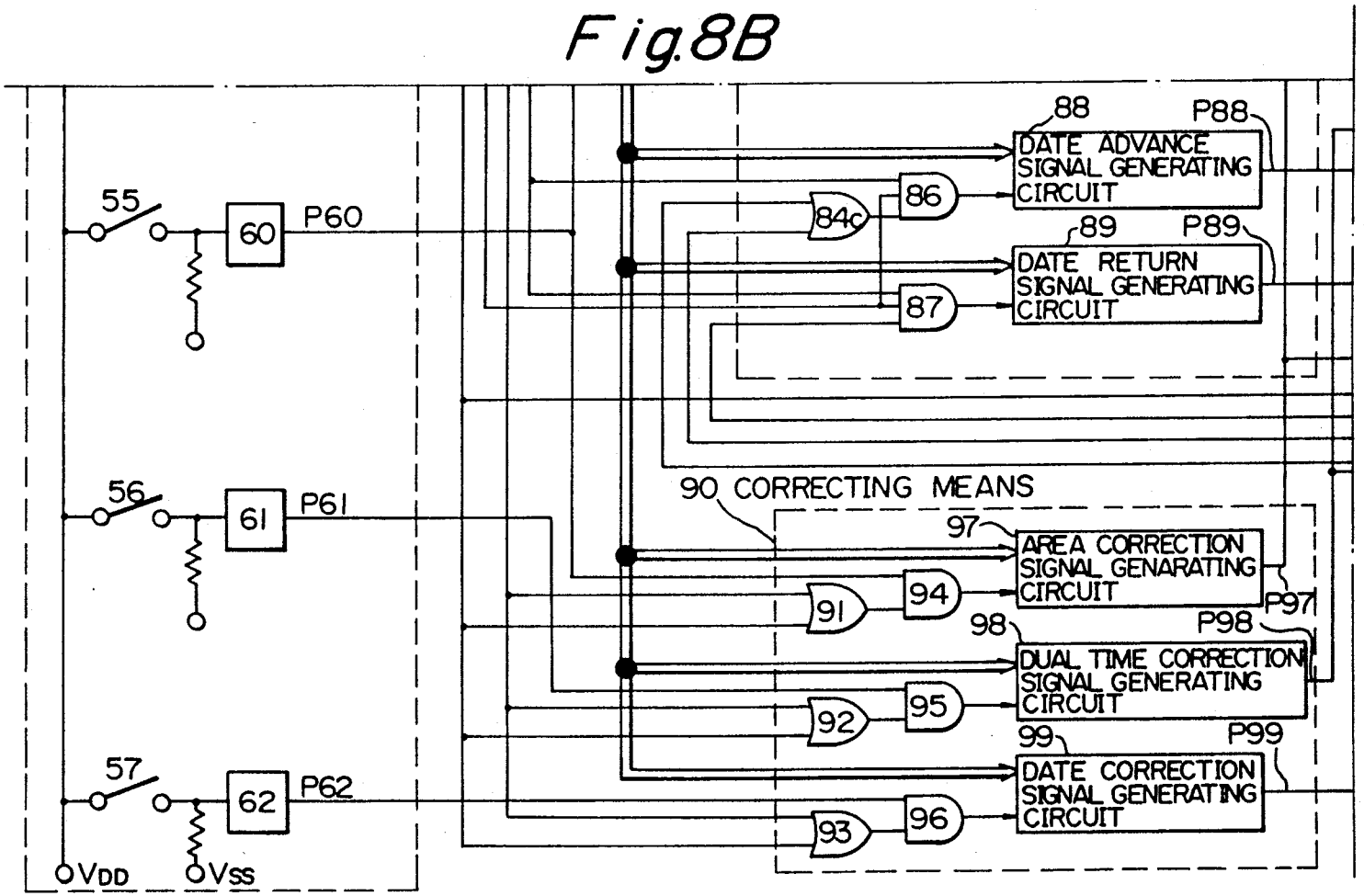
Figure 8C:
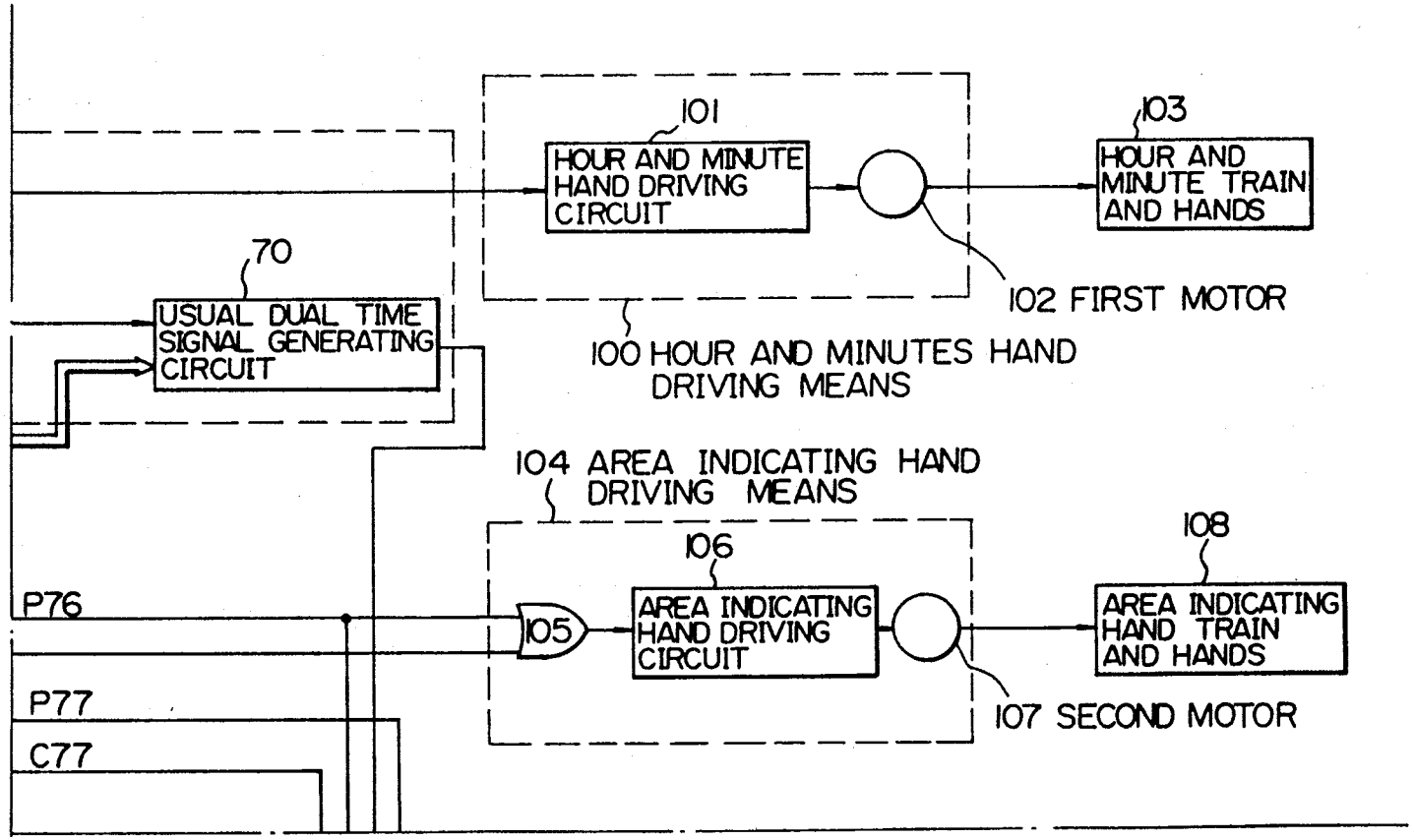
Figure 8D:
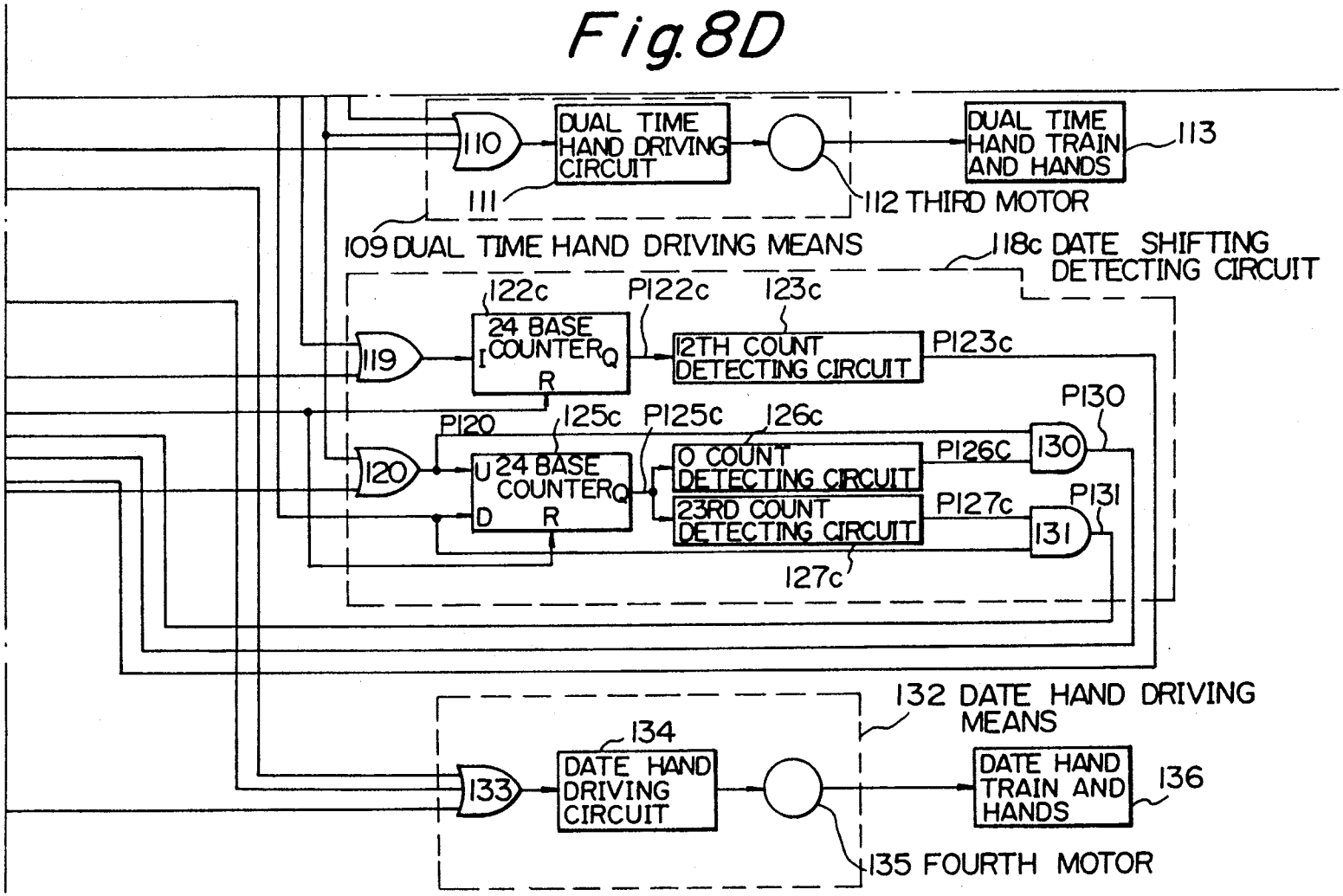

In FIG. 7, the summer time/normal time switching circuit of the embodiment of FIG. 2 is omitted, and instead, an east-bound rotation controlling circuit for the area indicating hand 5 is added. Naturally, this embodiment can also employ the normal/summer switching circuit and an east/west optional moving circuit for the area indicating hand 5. In FIG. 7, components that are the same as those of FIG. 2 are represented with identical reference marks. A difference between the embodiments of FIGS. 7 and 2 is that the embodiment of FIG. 7 does not have the normal/summer switching circuit 73 of FIG. 2 and, accordingly, the binary counter 116 of FIG. 2.

The third embodiment of FIG. 7 is characterized by a switch 55 having a west-bound rotating function for the area indicating hand 5; a switch 56 having an east-bound rotating function; and an area selecting circuit 72*b* involving, unlike the area selecting circuit 72 of FIG. 2, a west-bound rotating area signal generating circuit 76W, a dual time return signal generating circuit 77W for west bound rotation (a circuit for controlling the reverse rotation of a local time indicating hand, i.e., a dual time hand), an east-bound rotating area signal generating circuit 76E, and a dual time advance signal generating circuit 77E for east-bound rotation (a circuit for controlling the normal rotation of the dual time hand).

Unlike the embodiment of FIG. 2 that employs the 48-base counter 122 for controlling the area indicating hand, a date shifting detecting circuit 118*b* of the third embodiment employs a 24-base counter 122*b*. Further, instead of the 23rd count and 22nd count detecting circuits 123 and 124 of FIG. 2, the circuit 118*b* of the third embodiment employs 12th count and 11th count detecting circuits 123*b* and 124*b*. Accordingly, a drive controlling circuit 71*b* of FIG. 7 comprises an area selecting circuit 72*b* and a date displaying means 74.

A count-down input terminal D of the 24-base counter 122*b* receives an output signal C76E from the east-bound rotating area signal generating circuit 76E. An output of the dual time advance signal generating circuit 77E is supplied to a count-up input terminal U of another 24-base counter 125 of the date shifting detecting circuit 118*b*. Regional name symbols are arranged, for example, LON=0, AKL=12, PAR=23, MDY=11, etc. In this embodiment, the operation and movements of the area indicating hand 5 in the west-bound rotation are the same as those of the embodiment of FIG. 2, so that their explanations will be omitted.

The case of moving the area indicating hand 5 in the east direction will be explained.

Firstly, a crown 21 is set to a non-pulled position, and the switch 56 is turned ON. The switch 56 provides an output signal P61 to an AND 75E. Since other two inputs of the AND 75E are each "H", the signal P61 passes through the AND 75E and is supplied to the east-bound rotating area signal generating circuit 76E and to the dual time advance signal generating circuit 77E. According to the timing of a frequency-divided signal P51, the east-bound rotating area signal generating circuit 76E provides an output signal P76E to an area indicating hand driving means 104, thereby moving the area indicating hand 5 by one step to an area on the east side. At the same time, the signal generating circuit 76E provides a count signal C76E to the count-down input terminal D of the 24-base counter 122*b* of the date shifting detecting circuit 118*b*, thereby reducing the count of the counter 122*b*.

On the other hand, the dual time advance signal generating circuit 77E provides a signal P77E to a dual time hand driving means 109. Accordingly, a dual time hand (an area standard time indicating hand) driving circuit 111 is driven to advance the dual time hand by one hour.

The output signal P77E is also supplied to the count-up input terminal U of the 24-base counter 125 of the date shifting detecting circuit 118*b*, thereby increasing the counter of the counter 125. An operation of the date shifting detecting circuit 118*b* is the same as that of the date shifting detecting circuit 118 of FIG. 2. In the detecting circuit 118*b*, a signal P128*b* is supplied when the count of the 24-base counter 122*b* is changed from 11 to 12 to advance a date by one day. A signal P129*b* is supplied when the count of the 24-base counter 122*b* is changed from 12 to 11 to return a date by one day.

EXAMPLE 4

A world watch according to another embodiment of the present invention will be explained with reference to FIG. 8. The example of FIG. 8 is basically the same as that of FIG. 2 but has no normal time/summer time function. In addition, unlike the date shifting detecting circuit 118 referred to as the drive controlling circuit or the discrimination circuit of the previous embodiments, the embodiment of FIG. 8 moves an area indicating hand without judging and correcting a date in response to a turning direction of the area indicating hand. In FIG. 8, components that are the same as those of FIG. 2 are represented with identical reference marks. The embodiment of FIG. 8 does not have the normal/summer switching circuit 73 and mode controlling circuit 114 of the previous embodiments. A date shifting detecting circuit 118*c* of FIG. 8 employs a 24-base counter 122*c* instead of the 48-base counter 122, for checking the movement of the area indicating hand. Further, the circuit 118*c* employs only a 12th count detecting circuit 123*c* instead of the 23rd count and 22nd count detecting circuits 123 and 124 of FIG. 2. A date controlling circuit 74*c* slightly differs from that of FIG. 2.

Operations and movements of the fourth embodiment are nearly equal to those of the arrangement of FIG. 2. Relations of a date displaying means 74*c* to the date shifting detecting circuit 118*c* will be explained.

With a crown being at a non-pulled position, it is supposed that an area selecting button 18 is pushed. An AND 75 receives, as its first and second input signals, an inverted crown-second-pulled-position signal P63 and an inverted crown-first-pulled-position signal P64 from a switching circuit 53. The signals P63 and P64 are each "H" level, so that the AND 75 provides a third input signal, i.e., a first push signal P60 supplied from the switching circuit 52.

According to the timing of the first push signal P60 from the AND 75 and predetermined one of frequency-divided signals P51, an area changing signal generating circuit 76 provides an area changing signal P76 which is a one-shot signal for once driving the area indicating hand 5 in a normal rotating direction. The signal P76 is supplied to an area indicating hand driving means 104, which once moves the area indicating hand 5 from a certain city on regional name symbols 10 to the next city.

The area changing signal P76 is also supplied to an input terminal I to the 24-base counter 122*c* of the date shifting detecting circuit 118*c*, thereby increasing the count of the counter 122*c*. The counter 122*c* is storing a position of the hand 5 which has been corrected and set with the crown being at a first pulled position. If the 24-base counter 122*c* reaches a count of 12, i.e., if the area indicating hand 5 has been moved from MDY to AKL, the 12th count detecting circuit 123*c* is activated to provide a detected signal P123*c*. The signal P123*c* is supplied to an OR 84*c* of the date displaying means 74*c*, and then to an AND 86. The AND 86 receives, as its first and second input signals, the inverted crown-second-pulled-position signal P63 and inverted crown-first-pulled-position signal P64 from the switching circuit 52. These signals are each "H" level, so that the AND 86 provides its third input signal, i.e., the detected signal P123*c*. The signal P123*c* is supplied to a date advance signal generating circuit 88, which provides a one-shot signal P88 for advancing a date hand 6 in a normal turning direction by one day by means of a date hand driving means 132.

According to the timing of the first push signal P60 from the AND 75 and predetermined one of the frequency-divided signals P51, a dual return signal generating circuit 77 provides a dual return signal P77 for once driving a dual time hand 7 in a reverse turning direction. The signal P77 is supplied to a dual time hand driving means 109, which once drives the dual time hand 7 in the reverse turning direction. As a result, the dual time hand 7 is returned by one hour, thereby following the area indicating hand 5 which has been moved to the next area on the west side. Here, the dual time return signal generating circuit 77 provides together with the dual time return signal P77, a count signal C77, which is supplied to an input terminal D of a 24-base counter 125*c* of the date shifting detecting circuit 118*c*, thereby increasing the count of the counter 125*c*. At this time, if a zero count detecting circuit 126*c* is activated, a detected signal P123*c* is supplied to one input of AND 130. Another input of the AND 130 receives a signal of "L" level because a terminal U of the 24-base counter 125*c* is low level. The AND does not provide, therefore, a signal P130.

Similarly, if a 23rd count detecting circuit 127*c* is activated, a detected signal P127*c* is supplied to one input of an AND 131. Another input of the AND 131 receives a signal C77 of "H" level, so that the AND 131 provides an output signal P131 of "H" level. Then, an AND 87 of the date displaying means 74*c* receives, as its first and second input signals, the inverted crown-second-pulled-position signal P63 and inverted crown-first-pulled-position signal P64. Since the signals P63 and P64 are each "H" level with the crown being at the non-pulled position, the AND 87 provides the output signal P131 supplied from the AND 131 to a date return signal generating circuit 89.

According to the signal from the AND 87 and predetermined one of the frequency-divided signals P51, the date return signal generating circuit 89 provides a date return signal P89 for once driving the date hand 6 in the reverse turning direction. The signal P89 is supplied to a date hand driving means 132, which once drives the date hand 6 to follow the movement of the dual time hand 7, only when the dual time hand 7 has once been returned from "24" to "23" on dual time numerals 14.

As explained above, when the area selecting button 18 is pushed with the crown being at the non-pulled position to select an area, the date and dual time (world time) of the selected area are synchronized.

EXAMPLE 5

Figure 9:
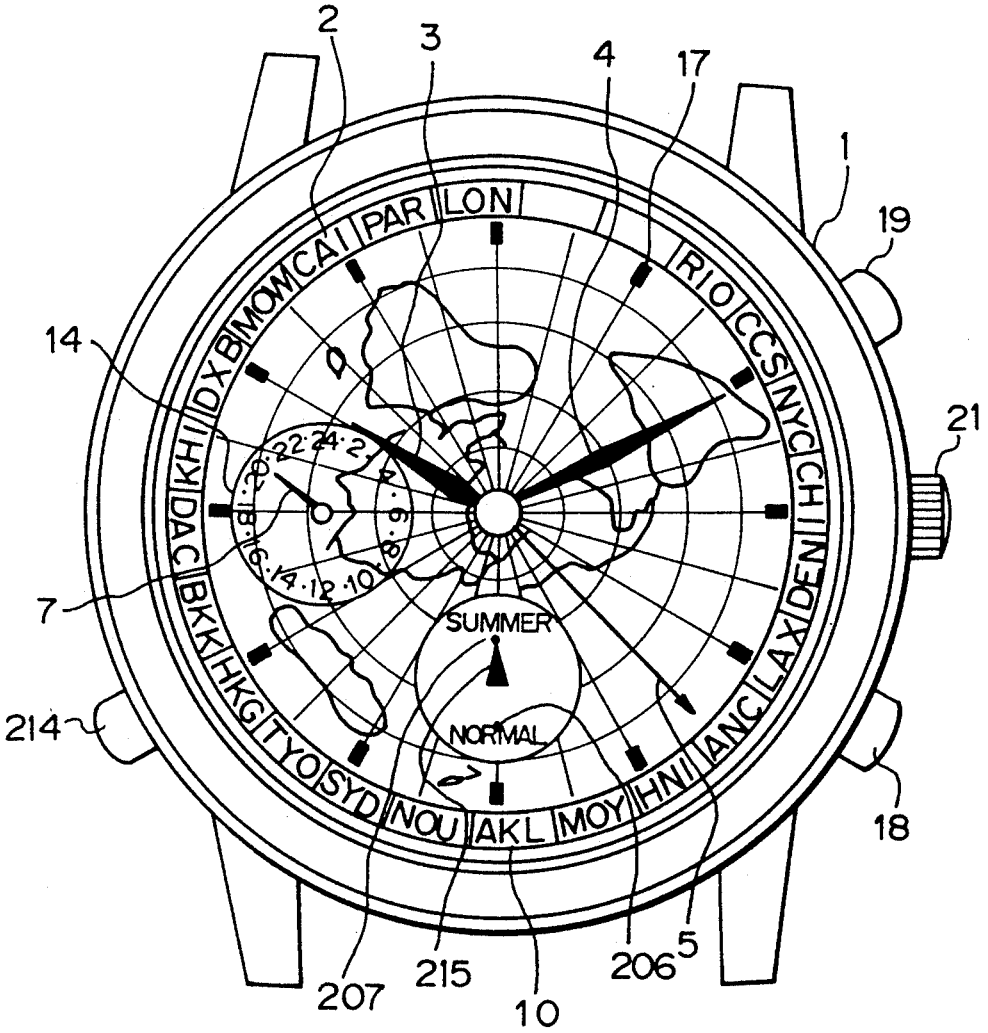
FIG. 9 is a front view showing the exterior of a world watch according to a fifth embodiment of the present invention.

In the above embodiments, the area indicating hand 5 and dual time hand 7 are correctly controlled by taking the International Date Line into account with use of the controlling circuits, i.e., the discrimination circuits. The fifth embodiment does not have such complicated functions but only a summer time/normal time switching circuit. FIG. 9 is an external front view showing an analog electronic watch having a world time function according to the fifth embodiment of the present invention. What is different from FIG. 1 is that, instead of the date hand 6 and date numerals 13, the fifth embodiment has a normal time scale 206, a summer time scale 207 and a mode hand 215 for selectively indicating the normal time and summer time scales. On the side face of the watch, a mode hand correcting button 214 is disposed, and a button 19 is used as a normal/summer switching button.

When a crown 21 is set to a second pulled position, a switch 53 is operated, When the crown 21 is set to a first pulled position, a switch 54 is operated. When a time zone selecting button 18 is pushed, a switch 55 is operated. When the normal/summer switching button 19 is pushed, a switch is operated. When the mode hand correcting button 214 is pushed, a switch 56 is operated.

The mode hand 215 is fitted to a dial 2. The mode hand 215 turns round by two steps to indicate one of the black-dot summer time scale 207 and bar-like normal time scale 206, thereby indicating which of a summer time function and a normal time function is selected.

Figure 10B:
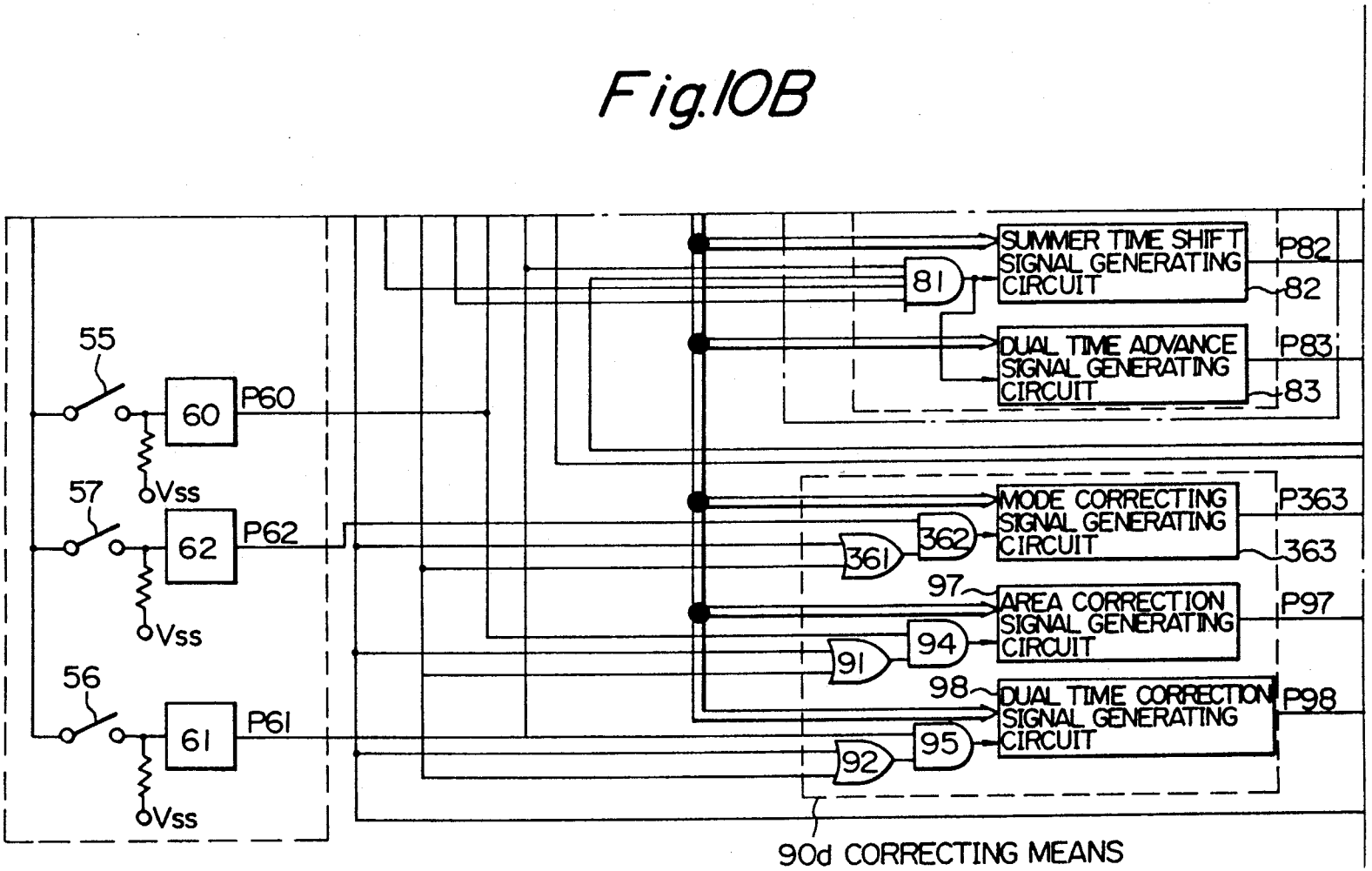
Figure 10C:
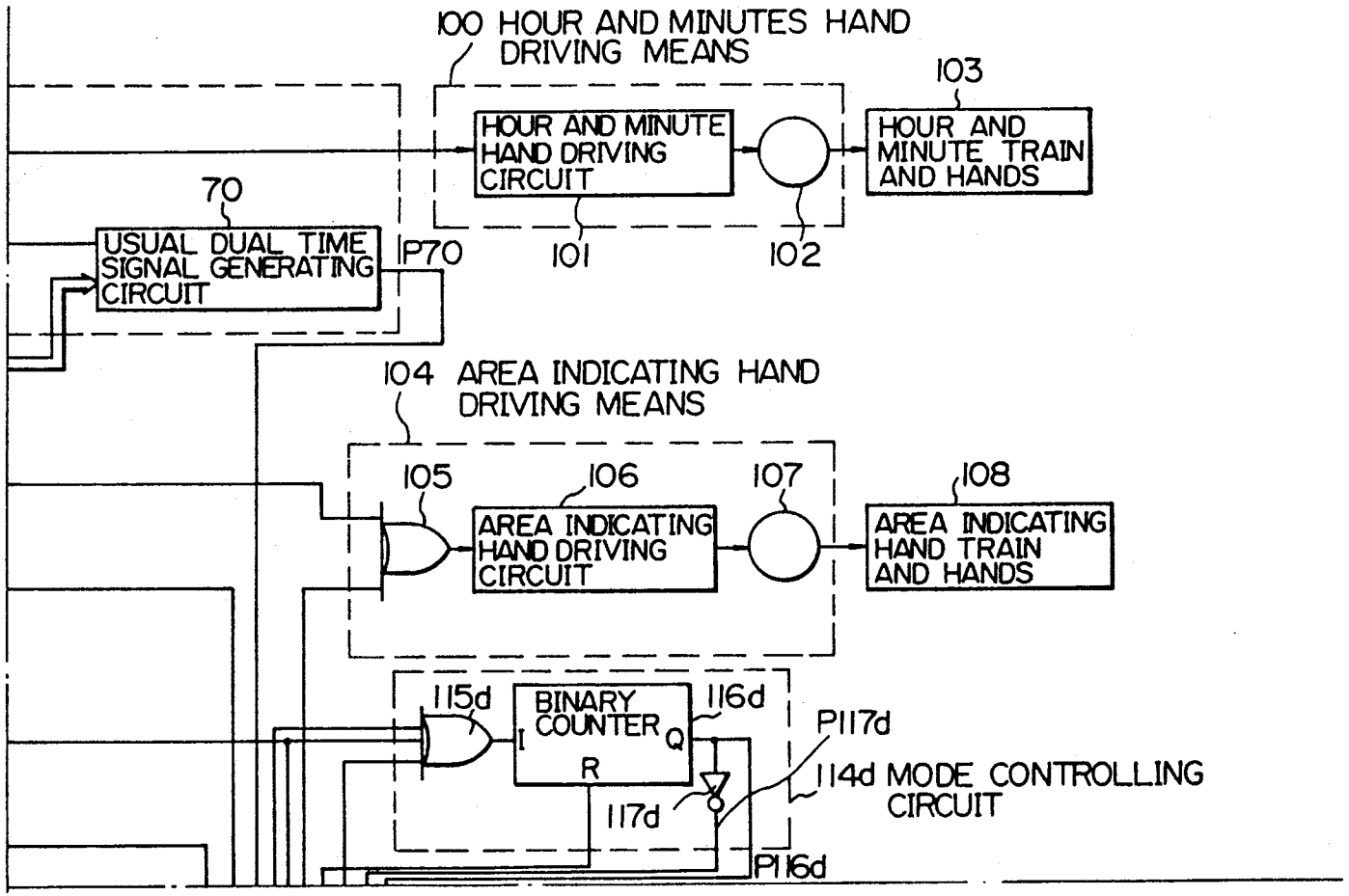
Figure 10D:
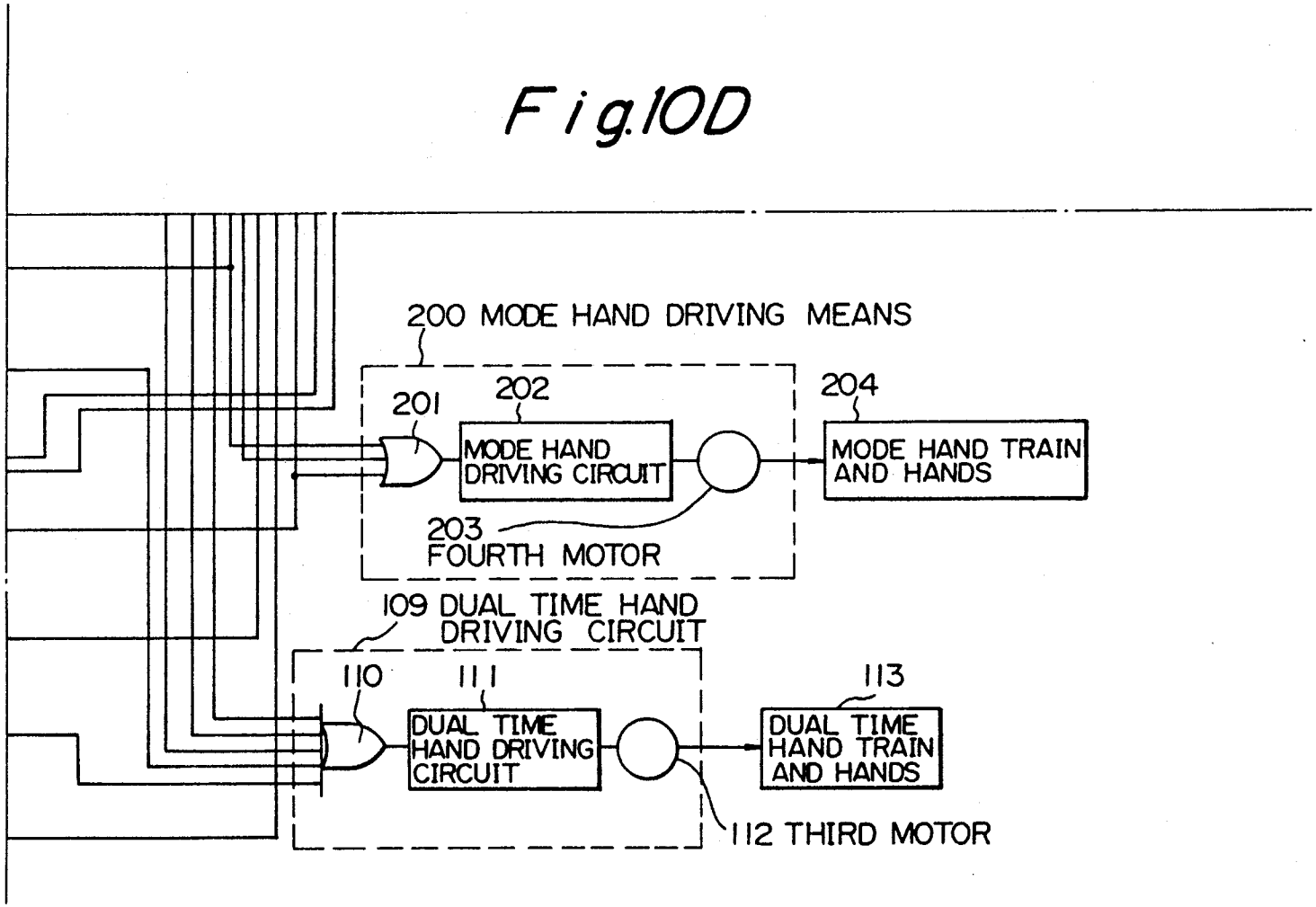

FIG. 10 is a circuit block diagram showing the embodiment of FIG. 9.

In FIG. 10, components that are the same as those of FIG. 2 are represented with identical reference marks.

The difference of FIG. 10 from FIG. 2 will be explained. A drive controlling circuit 71*d* of FIG. 10 does not include the date controlling circuit 74 of FIG. 2. A correcting means 90*d* has a mode correcting signal generating circuit 99*d* instead of the date correcting signal generating circuit 99 of the correcting means 90 of FIG. 2. The arrangement of FIG. 10 does not have the date shifting detecting circuit 118 of FIG. 2. Instead, FIG. 10 has a mode hand driving means 200. Wiring to respective circuits of FIG. 10 is also different from that of FIG. 2. The details of FIG. 10 will be explained. By pushing the time zone selecting button 18, normal/summer switching button 19 and mode hand correcting button 214, the switches 55, 56 and 57 are turned ON, respectively, to output first push signal P60, second push signal P61 and third push signal P62, respectively.

Similar to the mode controlling circuit 114 of FIG. 2, the mode controlling circuit 114*d* comprises a binary counter 116*d*, an OR 115*d* and an INV 117*d*. An input terminal I of the binary counter 116*d* receives an output signal of the OR 115*d*, and a reset input terminal R thereof receives a crown-second-pulled-position signal P58. According to these input signals, the binary counter 116*d* provides, from its output terminal Q, a summer mode signal P116*d* under a summer time function selected state, and a normal mode signal P117*d* through the INV 117*d* under a normal time function selected state.

The mode hand driving means 200 comprises an OR 201, a mode hand driving circuit 202 that receives an output signal of the OR 201, and a fourth motor 203 driven according to an output signal of the circuit 202 to drive mode hand train and hands.

The dual time hand driving means 109 comprises an OR 110, a dual time hand driving circuit 111 that receives an output signal of the OR 110, and a third motor 112 driven according to an output signal of the circuit 111.

Operations of the circuits of this embodiment are basically the same as those of FIG. 2, so that explanations are omitted. Operations peculiar to the embodiment will be explained.

With the crown 21 being at a second pulled position, it is supposed that the switching circuit 52 provides the third push signal P62. In the correcting means 90*d*, one input of an OR 361 receives the crown-second-pulled-position signal P58 of "H" level and provides the same to an AND 362. Accordingly, the AND 362 provides its other input signal, i.e., the third push signal P62.

According to the timing of the third push signal P62 from the AND 362 and predetermined one of frequency-divided signals P51, the mode correcting signal generating circuit 99*d* provides a mode correcting signal P363 which is a one-shot signal for driving the mode hand 215 once in a normal turning direction. The signal P363 is supplied to the mode hand driving means 200, which once drives the mode hand 215 in the normal turning direction.

The mode correcting signal P363 is also supplied to the mode controlling circuit 114*d*. In the mode controlling circuit 114*d*, however, the binary counter 116*d* is reset by the crown-second-pulled-position signal P58, so that the normal mode signal P117*d* from the INV 117*d* is continuously provided.

For initialization, a user adjusts the mode hand 215 to the normal time scale 206, and then the mode hand 215 and mode controlling circuit 114*d* are phased to each other. With the crown 21 being at the second pulled position, other circuits such as the time displaying means 65 and drive controlling circuit 71*d* are not operated at all. Next, it is supposed that the switching circuit 52 provides the first push signal P60 with the crown 21 at a first pulled position. In the correcting means 90*d*, an OR 91 provides its one input signal, i.e., the crown-first-pulled-position signal P59. When the first push signal P60 is provided from the switching circuit 52 with the crown being at the first pulled position, the OR 91 provides the crown-second-pulled-position signal P57 of "H" level to one input of an AND 94. Then, the AND 94 provides its other input signal, i.e., the first push signal P60.

According to the timing of the first push signal P60 from the AND 94 and predetermined one of the frequency-divided signals P51, the area hand correction on signal generating circuit 97 provides a hand correcting signal P97 which is a one-shot signal for driving the area indicating hand 5 once in a normal turning direction. When the signal P97 is supplied to the area indicating hand driving means 104, the area indicating hand 5 is driven once in the normal turning direction.

With the crown being at the first pulled position, it is supposed that the switching circuit 52 provides the third push signal P62. In the correcting means 90*d*, the OR 361 receives the crown-first-pulled-position signal P59 and outputs the same. Similar to the crown-second-pulled-position state, the mode hand 215 is once driven in the normal turning direction according to the mode hand correcting signal P363.

In the mode controlling circuit 114*d*, however, the binary counter 116*d* is not reset with the crown being at the first pulled position, so that an output level of the binary counter 116*d* is inverted by the simultaneous supply of the mode hand correcting signal P363.

Namely, if the normal mode signal P117*d* is being supplied, the summer mode signal P116*d* starts to be supplied, and if the summer mode signal P116*d* is being supplied, the normal mode signal P117*d* starts to be supplied. For every pushing operation, the mode hand 215 alternately indicates the normal time scale 206 and summer time scale 207. With the crown being at the first pulled position, it is supposed that the switching circuit 52 provides the second push signal P61. In the correcting means 90*d*, one input signal of the AND 95 is the crown-first-pulled-position signal P59 of "H" level, so that the AND 95 provides its other input signal, i.e., the second push signal P61 which has passed the OR 92.

According to the timing of the second push signal P61 from the AND 95 and predetermined one of the frequency-divided signals P51, the dual time correcting signal generating circuit 98 provides a dual time correcting signal P98 which is a one-shot signal for once driving the dual time hand 7 once in a normal turning direction. When the signal P98 is supplied to the dual time hand driving means 109, the dual time hand 7 is driven once in the normal turning direction.

Namely, with the crown being at the first pulled position, the two buttons 18 and 19 are pushed to adjust the dual time of an optional city taking summer time of the city into consideration.

With the crown being at the first pulled position, the inverted crown-second-pulled-position signal P63 from the switching circuit 52 is "H" level to put a time signal generating circuit 66 of the time displaying means 65 into an output enable state. Accordingly, a time signal P66 of one minute interval is supplied in response to predetermined one of the frequency-divided signals P51. When the signal P66 is supplied to an hour and minute hands driving means 100, a minute hand 4 is driven for one minute portion, with an hour hand 3 interlocking with the minute hand 4.

With the crown being at the first pulled position, the drive controlling circuit 71*d* is not operated.

Operations of the normal/summer switching circuit 73, mode controlling circuit 114*d* and mode hand driving means 200 will be explained.

Switching from summer time to normal time will be explained.

Firstly, the normal/summer switching button 19 is pushed with the crown being at the non-pulled position under a summer time function selected state. An AND 78 receives, as its first, second and third input signals, the summer mode signal P117*d* from the mode controlling circuit 114*d* and the inverted crown-second-pulled-position signal P63 and inverted crown-first-pulled-position signal P64 from the switching circuit 52. These input signals are each "H" level, so that the AND 78 provides its fourth input signal, i.e., the second push signal P61 supplied from the switching circuit 52.

According to the timing of the second push signal P61 from the AND 78 and predetermined one of the frequency-divided signals P51, a normal shift signal generating circuit 79 provides a normal shift signal P79 which is a one-shot signal for driving the mode hand 215 once in a normal turning direction. When the signal P79 is supplied to the mode hand driving means 200, the mode hand 215 is driven once in the normal turning direction. As a result, the mode hand 215 is moved from the summer time scale 207 to the normal time scale 206. At the same time, the normal shift signal P79 is supplied to the mode controlling circuit 114*d*. Then, the binary counter 116*d* is inverted, and instead of the summer mode signal P116*d*, the normal mode signal P117*d* is supplied to change the mode.

According to the timing of the second push signal P61 from the AND 78 and predetermined one of the frequency-divided signals P51, the dual time return signal generating circuit 80 provides a dual time return signal P80 for driving the dual time hand 7 once in a reverse turning direction. When the signal P80 is supplied to the dual time hand driving means 109, the dual time hand 7 is driven once to follow the mode hand 215 that has been moved to the normal time scale 206, so that the dual time display is delayed by one hour.

Switching from normal time to summer time will be explained.

With the crown being at the non-pulled position with the mode hand 215 indicating the normal time scale 206, the normal/summer switching button 19 is pushed. The AND 81 receives, as its first, second and third input signals, the normal mode signal P117*d* from the mode controlling circuit 114*d* and the inverted crown-second-pulled-position signal P63 and inverted crown-first-pulled-position signal P64 from the switching circuit 52. Since these three input signals are each "H" level, the AND 81 provides its fourth input signal, i.e., the second push signal P61 from the switching circuit 52.

According to the timing of the second push signal P61 from the AND 81 and predetermined one of the frequency-divided signals P51, the summer time shift signal generating circuit 82 provides a summer time shift signal P82 which is a one-shot signal for driving once the mode hand 215 in a normal turning direction. When the signal P82 is supplied to the mode hand driving means 200, the mode hand 215 is driven once in the normal rotating direction to indicate the summer time scale 207. The summer time shaft signal P82 is also supplied to the mode controlling circuit 114*d* to invert the binary counter 116*d*. As a result, the summer mode signal P116*d* is provided instead of the normal mode signal p117*d*, thereby changing the mode.

According to the timing of the second push signal P61 from the AND 81 and predetermined one of the frequency-divided signals P51, the dual time advance signal generating circuit 82 provides a dual time advance signal P83 for driving once the dual time hand 7 in a normal turning direction. When the signal P83 is supplied to the dual time hand driving means 109, the dual time hand 7 is driven once in the normal turning direction to advance the dual time indication by one hour, thereby following the mode hand 215 that has been moved to the summer time scale 207.

As described above, an analog electronic watch according to the present invention indicates not only local standard time information of a specified area but also correct date information thereof, thereby widening practical usage of the watch.

When a user of the watch manipulated it in various ways to see changes in date display, the user may learn the meaning of the International Date Line and its position. For example, it is understood that a time difference between Auckland and Midway is seemingly about one hour but actually 23 hours. The various hands of the watch may also tell the user of a place having the earliest time in the world and time variations of various areas in the world. In this way, the watch according to the present invention can provide many pieces of information in an analog form that is a main stream of current electronic watches. In addition, the watch of the present invention is fashionable and practical.

Further, the watch of the present invention can indicate normal time and summer time for each time zone. According to the indication of the summer or normal time, the local time of the time zone in question is automatically corrected and displayed, so that no error may occur in reading the local time.

We claim:

1. An analog world watch, comprising:

an hour hand and a minute hand for usual time indication with a plurality of symbols disposed on a dial to represent areas having respective time difference;

an area indicating hand for specifying one of said areas by indicating one of said plurality of symbols, a local time indicating hand for indicating the local time of said specified one of said areas at least in hours, a date indicating hand for indicating a date of said one of said specified areas, said hands being driven by respective step motors each having a driving circuit, at least two counting means, including a first counting means for counting the number of driving signals used for driving said area indicating hand, and including a second counting means for counting the number of driving signals used for driving said local time indicating hand; and a drive controlling circuit for generating, at times when the count of at least one of said counting means reaches a predetermined value, a driving signal for driving said date indicating hand in a normal or reverse turning direction based on a determination as to whether said predetermined value is attained by an increase in the count or by a decrease in the count, utilizing an up-and-down counting function provided in said counting means in accordance with a moving direction of any one of said area indicating hand and said local time indicating hand.

2. An analog world watch according to claim 1, wherein the predetermined value is a reference count value corresponding to the International Date line said date indicating hand being driven in the normal turning direction at times when the count of said counting means is increased beyond said reference count value and driven in the reverse direction at times when the count of said counting means is decreased from said reference count value.

3. An analog world watch according to claim 1 or 2, wherein each of said time difference areas has a normal time mark and a summer time mark that are selectively aligned with said area indicating hand, and said drive controlling circuit includes a circuit means for advancing said local time indicating hand and corresponding one of said counting means by one hour at times when said area indicating hand is moved from the normal time mark to the summer time mark in one of said areas.

4. An analog world watch according to claim 1, further comprising:

a month indicating hand rotatably mounted to align with a symbol representing one of a plurality of months for indicating a month;

a driving means for driving said month indicating hand; and a quick-feed controlling circuit means for causing said date indicating hand to skip non-existing dates of months having less than 31 days.

5. An analog world watch according to claim 2, further comprising:

a month indicating hand rotatably mounted to align with a symbol representing one of a plurality of months for indicating a month;

a driving means for driving said month indicating hand; and a quick-feed controlling circuit means for causing said date indicating hand to skip non-existing dates of months having less than 31 days.

6. An analog world watch according to claim 3, further comprising:

a month indicating hand rotatably mounted to align with a symbol representing one of a plurality of months for indicating a month;

a driving means for driving said month indicating hand; and a quick-feed controlling circuit means for causing said date indicating hand to skip non-existing dates of months having less than 31 days.

7. An analog world watch comprising an hour hand and a minute hand for usual time indication, with a plurality of symbols disposed on a dial to represent areas having respective time differences, an area indicating hand for specifying one of said areas by indicating one of said symbols, a local time indicating hand for indicating the local time of said specified area at least in hours, a date indicating hand for indicating a date of said specified area, a driving circuit including step motors for driving said hands, counting means for counting the driving signals applied to the step motors for driving said areas indicating hand and local time indicating hand, respectively to store the positions of said hands;

a discriminating circuit means for determining whether the count of said counting means has reached a predetermined value by an increase in the count or by a decrease in the count, to determine from which direction the hand corresponding to said counting means has reached a predetermined position; and a drive controlling circuit for controlling the rotating direction of said area indicating hand and local time indicating hand according to said discriminating circuit means, said drive controlling circuit and discriminating circuit means being operative to move said local time indicating hand in a reverse direction at times when said area indicating hand is moved in a westward direction, and operative to move said date indicating hand a distance corresponding to one day in a normal direction when said area indicating hand crosses a position corresponding to the International Date Line.

8. An analog watch comprising a world time function for indicating, in addition to the time of a present place, the standard time of another place, a first dial having a plurality of areas each having a symbol corresponding to an area name, said areas being defined by angles corresponding to time differences relative to the Greenwich Mean Time (GMT) or the World Time defined by Universal Time Coordinated (UTC);

an area hand for indicating one of said area symbols on said first dial;

a second dial having a normal time symbol and a summer time symbol for identifying that presently displayed world time is normal time or summer time;

a summer time hand for indicating one of said normal and summer time symbols on said second dial;

a drive controlling circuit for calculating a specific time difference, relative to the GMT or the World Time defined by Universal Time Coordinated (UTC), of one of said areas when said summer time hand is indicating the normal time symbol of said one area, and calculating the summer time for said one area by adding one hour to said calculated specific time difference when said summer time hand is indicating the summer time symbol of said one area; and means for rotating local time hands for indicating the local time of said one area, in accordance with the calculation of said drive controlling circuit.

9. An analog world watch comprising an hour hand and a minute hand for time indication and a plurality of symbols disposed on a dial to represent areas having respective time differences, said analog world watch:

a rotatable area indicating hand for aligning with one of the symbols to indicate a corresponding area;

a rotatable local time indicating hand for indicating local time, at least in hours, of an indicated area;

a driving circuit for each of the rotatable hands for rotating the respective hand a predetermined distance in a forward direction in response to each of a plurality of first driving signals, the driving circuit for at least the local time indicating hand being operative to rotate the local time indicating hand said predetermined distance in a reverse direction in response to each of a plurality of second driving signals;

counting circuit means responsive to the generation of each first driving signal for operating a counter in one direction and responsive to the generation of each second driving signal for operating a counter in an opposite direction, said counting circuit means including means for generating a first count signal at times when the counter operates in the one direction to count a predetermined value and for generating a second count signal at times when the counter operates in the opposite direction to count the predetermined value; and a drive controlling circuit responsive to the first count signal for generating the first driving signal to rotate the corresponding hand in the forward direction and responsive to the second count signal to rotate at least said local time indicating hand in a reverse direction.

10. The world analog watch of claim 9 wherein the one direction of the counter corresponds to an increase in the count and the opposite direction corresponds to a decrease in the count.

11. The world analog watch of claim 10 wherein the driving circuit for the date indicating hand is operative to rotate the date indicating hand in a reverse direction in response to one of the second driving signals.

12. The world analog watch of claim 9 wherein the driving circuit for the area indicating hand is operative to rotate the area indicating hand in a reverse direction in response to one of the second driving signals; and manual means for selectively generating the first and second driving signals for the area indicating hand driving circuit.

* * * * *

UNITED STATES PATENT AND TRADEMARK OFFICE

CERTIFICATE OF CORRECTION

PATENT NO. : 5,237,544

DATED : August 17, 1993

INVENTOR(S) : MASAHIRO SASE ET AL.

It is certified that error appears in the above-identified patent and that said Letters Patent is hereby corrected as shown below:

Claim 2, column 25, line 62, "line said" should read --line, said--.

Claim 9, column 27, line 42, delete "said analog world watch:".

Signed and Sealed this

Thirteenth Day of September, 1994

Bruce Lehman

*Attest:*

BRUCE LEHMAN

*Attesting Officer*

*Commissioner of Patents and Trademarks*